US009039508B1

(12) United States Patent
Arnone et al.

(10) Patent No.: US 9,039,508 B1
(45) Date of Patent: May 26, 2015

(54) MULTI-MODE MULTI-JURISDICTION SKILL WAGERING INTERLEAVED GAME

(71) Applicant: Gamblit Gaming, LLC, Glendale, CA (US)

(72) Inventors: Miles Arnone, Sherborn, MA (US); Clifford Kaylin, Los Angeles, CA (US); Eric Meyerhofer, Pasadena, CA (US); Frank Cire, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 14/205,306

(22) Filed: Mar. 11, 2014

Related U.S. Application Data

(60) Provisional application No. 61/907,854, filed on Nov. 22, 2013, provisional application No. 61/926,898, filed on Jan. 13, 2014, provisional application No. 61/919,370, filed on Dec. 20, 2013, provisional application No. 61/918,359, filed on Dec. 19, 2013, provisional application No. 61/915,369, filed on Dec. 12, 2013.

(51) Int. Cl.
*G07F 17/32* (2006.01)

(52) U.S. Cl.
CPC ..... *G07F 17/3227* (2013.01)

(58) Field of Classification Search
CPC ..... G06Q 20/3224; G07F 17/3223; G07F 17/3227; H04L 63/104
USPC ..... 463/42, 16
See application file for complete search history.

(56) References Cited

U.S. PATENT DOCUMENTS 5,413,357 A 5/1995 Schulze et al.
5,718,429 A 2/1998 Keller
5,785,592 A 7/1998 Jacobsen (Continued)

FOREIGN PATENT DOCUMENTS

JP 2001300098 A 10/2001
JP 2003111980 A 4/2003

(Continued)

OTHER PUBLICATIONS itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

(Continued)

*Primary Examiner* — Corbett B Coburn
(74) *Attorney, Agent, or Firm* — Dwight Kim

(57) ABSTRACT

Methods and apparatus for a gaming system are provided. The gaming system enables a player to engage in various types of gaming depending on the jurisdiction in which the player is located. For example, depending on the jurisdiction of a player's device, the gaming system may allow the player to wager using real world currency, or virtual currency. If the player's device is located in a jurisdiction that allows gambling using real world currency, the gaming system may allow the player to place wagers using real world currency. Alternatively, if the player's device is located in a jurisdiction that does not allow gambling using real world currency, the gaming system may limit the player to placing wagers using virtual currency.

3 Claims, 20 Drawing Sheets

(56) References Cited

U.S. PATENT DOCUMENTS 5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,216,072 B2 7/2012 Curtis et al.
8,475,266 B2 7/2013 Arnone
8,480,470 B2 7/2013 Napolitano et al.
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0102956 A1* 5/2008 Burman et al. ..... 463/42
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.

(56) References Cited

U.S. PATENT DOCUMENTS

| | | | |
|---|---|---|---|
| 2009/0176560 | A1 | 7/2009 | Herrmann et al. |
| 2009/0176566 | A1 | 7/2009 | Kelly |
| 2009/0181777 | A1 | 7/2009 | Christiani |
| 2009/0221355 | A1 | 9/2009 | Dunaevsky et al. |
| 2009/0239610 | A1 | 9/2009 | Olive |
| 2009/0247272 | A1 | 10/2009 | Abe |
| 2009/0270164 | A1 | 10/2009 | Seelig |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0029373 | A1 | 2/2010 | Graham et al. |
| 2010/0035674 | A1 | 2/2010 | Slomiany |
| 2010/0056247 | A1 | 3/2010 | Nicely |
| 2010/0056260 | A1 | 3/2010 | Fujimoto |
| 2010/0062836 | A1 | 3/2010 | Young |
| 2010/0069144 | A1 | 3/2010 | Curtis et al. |
| 2010/0093420 | A1 | 4/2010 | Wright |
| 2010/0093444 | A1 | 4/2010 | Biggar et al. |
| 2010/0105454 | A1 | 4/2010 | Weber |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0184509 | A1 | 7/2010 | Sylla et al. |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227675 | A1* | 9/2010 | Luxton et al. ..... 463/25 |
| 2010/0227688 | A1 | 9/2010 | Lee |
| 2010/0240436 | A1 | 9/2010 | Wilson et al. |
| 2010/0304825 | A1 | 12/2010 | Davis |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0045896 | A1 | 2/2011 | Sak et al. |
| 2011/0077087 | A1 | 3/2011 | Walker et al. |
| 2011/0082571 | A1 | 4/2011 | Murdock et al. |
| 2011/0105206 | A1 | 5/2011 | Rowe et al. |
| 2011/0107239 | A1 | 5/2011 | Adoni |
| 2011/0109454 | A1 | 5/2011 | McSheffrey |
| 2011/0111820 | A1 | 5/2011 | Filipour |
| 2011/0111837 | A1 | 5/2011 | Gagner |
| 2011/0111841 | A1 | 5/2011 | Tessmer |
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0230267 | A1 | 9/2011 | Van Luchene |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2011/0319169 | A1 | 12/2011 | Lam |
| 2012/0004747 | A1 | 1/2012 | Kelly |
| 2012/0028718 | A1 | 2/2012 | Barclay et al. |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0135793 | A1 | 5/2012 | Antonopoulos |
| 2012/0202587 | A1 | 8/2012 | Allen |
| 2012/0302311 | A1 | 11/2012 | Luciano |
| 2012/0322545 | A1 | 12/2012 | Arnone et al. |
| 2013/0029760 | A1 | 1/2013 | Wickett |
| 2013/0131848 | A1 | 5/2013 | Arnone et al. |
| 2013/0190074 | A1 | 7/2013 | Arnone et al. |
| 2014/0051497 | A1 | 2/2014 | Lang et al. |

FOREIGN PATENT DOCUMENTS

| | | | |
|---|---|---|---|
| JP | 2004097610 | A | 4/2004 |
| JP | 2004166746 | A | 6/2004 |
| WO | 9851384 | A1 | 11/1998 |
| WO | 2010087090 | A1 | 8/2010 |
| WO | 2011109454 | A1 | 9/2011 |
| WO | 2012139083 | A1 | 10/2012 |
| WO | 2013059308 | A1 | 4/2013 |

OTHER PUBLICATIONS

Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/185,847 Arnone, et al., filed Feb. 20, 2014.
U.S. Appl. No. 14/203,459 Arnone, et al., filed Mar. 10, 2014.
Miles Arnone, U.S. Appl. No. 14/205,272, filed Mar. 11, 2014.
Office action in U.S. Appl. No. 14/205,272, mailed Jun. 11, 2014.

* cited by examiner

MULTI-MODE MULTI-JURISDICTION SKILL WAGERING INTERLEAVED GAME

CROSS-REFERENCE TO RELATED APPLICATIONS

This application claims the priority to and the benefit of U.S. Provisional Patent Application No. 61/907,854, filed Nov. 22, 2013, U.S. Provisional Patent Application No. 61/915,369, filed Dec. 12, 2013, U.S. Provisional Patent Application No. 61/918,359, filed Dec. 19, 2013, U.S. Provisional Patent Application No. 61/919,370, filed Dec. 20, 2013, and U.S. Provisional Patent Application No. 61/926,898, filed Jan. 13, 2014, the entire contents of each of which are hereby incorporated by reference herein.

FIELD

Embodiments of the present invention relate to a multi-mode multi-jurisdiction skill wagering interleaved game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game can depend upon a player's skill with the game. Gambling games are typically not as interactive and do not include graphics as sophisticated as an entertainment game, which is a game of skill such as a video game. Additionally, gambling games that allow users to wager actual currency may be prohibited in certain geographical locations, and allowed in other geographical locations.

SUMMARY

Systems and methods in accordance with embodiments of the invention provide a multi-mode multi-jurisdiction skill wagering interleaved game.

According to aspects of embodiments of the present invention, a gaming system includes: at least one processor; a memory coupled to the at least one processor, the memory storing processor-executable instructions executed by the at least one processor, the processor-executable instructions comprising: instantiating a plurality of game world operating systems (GW.OSes) each configured to manage a game configuration for a game operating on a player's device; determining a geographical location of a player's device; selecting a first game world operating system (GW.OS) of the plurality of GW.OSes based on the geographical location of the player's device being in a jurisdiction allowing real money gaming, wherein the first GW.OS of the plurality of GW.OSes is configured to manage the game configuration using real money gaming; and managing the game using the first GW.OS.

In one embodiment, the processor-executable instructions further include: selecting a second GW.OS of the plurality of GW.OSes based on the geographical location of the player's device being in a jurisdiction not allowing real money gaming, wherein the second GW.OS of the plurality of GW.OSes is configured to manage the game using virtual money gaming.

In one embodiment, the processor-executable instructions further include: determining the managing of the game using the first GW.OS based on the geographical location of the player's device moving to the jurisdiction not allowing real money gaming; and managing the game using the second GW.OS.

In one embodiment, the processor-executable instructions further include: receiving a request from the player's device to initiate a session of the game, wherein the request comprises location information for the player's device, wherein the location information comprises global positioning system (GPS) data of the player's device or network access point information of the player's device; and the detecting of the geographical location of the player's device further comprises determining the geographical location of the player's device based on the GPS data or the network access point information.

In one embodiment, the managing of the game using the first GW.OS further comprises: receiving an instruction from the player's device to initiate a real money wager regarding an event occurring in the game; obtaining a wager outcome for the event; and transmitting the wager outcome to the player's device.

In one embodiment, the obtaining of the wager outcome for the event further comprises calculating, as the wager outcome, a credit amount to be added or subtracted from a wagered amount using at least one of a random number generator or a pay table.

According to aspects of embodiments of the present invention, in a method of operating a gaming system, the method includes: instantiating, by one or more processors, a plurality of game world operating systems (GW.OSes) each configured to manage a game configuration for a game operating on a player's device; determining, by the one or more processors, a geographical location of a player's device; selecting, by the one or more processors, a first game world operating system (GW.OS) of the plurality of GW.OSes based on the geographical location of the player's device being in a jurisdiction allowing real money gaming, wherein the first GW.OS of the plurality of GW.OSes is configured to manage the game configuration using real money gaming; and managing, by the one or more processors, the game using the first GW.OS.

In one embodiment, the method further includes: selecting, by the one or more processors, a second GW.OS of the plurality of GW.OSes based on the geographical location of the player's device being in a jurisdiction not allowing real money gaming, wherein the second GW.OS of the plurality of GW.OSes is configured to manage the game using virtual money gaming.

In one embodiment, the method further includes: terminating, by the one or more processors, the managing of the game using the first GW.OS based on the geographical location of the player's device moving to the jurisdiction not allowing real money gaming; and managing, by the one or more processors, the game using the second GW.OS.

In one embodiment, the method further includes: receiving, by the one or more processors, a request from the player's device to initiate a session of the game, wherein the request comprises location information for the player's device, wherein the location information comprises global positioning system (GPS) data of the player's device or network access point information of the player's device; and the detecting of the geographical location of the player's device further comprises determining, by the one or more processors, the geographical location of the player's device based on the GPS data or the network access point information.

In one embodiment, the method further includes: receiving, by the one or more processors, an instruction from the player's device to initiate a real money wager regarding an event occurring in the game; obtaining, by the one or more processors, a wager outcome for the event; and transmitting, by the one or more processors, the wager outcome to the player's device.

In one embodiment, the obtaining of the wager outcome for the event further comprises calculating, by the one or more processors, as the wager outcome, a credit amount to be added or subtracted from a wagered amount using at least one of a random number generator or a pay table.

In one embodiment, the method may further include allocating, by the one or more processors, one or more game world resources regarding the game.

According to aspects of embodiments of the present invention, in a non-transitory processor-readable storage medium having stored processor-executable instructions for a gaming system, the processor-executable instructions include: instantiating a plurality of game world operating systems (GW.OSes) each configured to manage a game configuration for a game operating on a player's device; determining a geographical location of a player's device; selecting a first game world operating system (GW.OS) of the plurality of GW.OSes based on the geographical location of the player's device being in a jurisdiction allowing real money gaming, wherein the first GW.OS of the plurality of GW.OSes is configured to manage the game configuration using real money gaming; and managing the game using the first GW.OS.

In one embodiment, the processor-executable instructions further include: terminating the managing of the game using the first GW.OS based on the geographical location of the player's device moving to the jurisdiction not allowing real money gaming; and managing the game using the second GW.OS.

In one embodiment, the processor-executable instructions further include: receiving a request from the player's device to initiate a session of the game, wherein the request comprises location information for the player's device, wherein the location information comprises global positioning system (GPS) data of the player's device or network access point information of the player's device; and the detecting of the geographical location of the player's device further comprises determining the geographical location of the player's device based on the GPS data or the network access point information.

In one embodiment, the processor-executable instructions further include: receiving an instruction from the player's device to initiate a real money wager regarding an event occurring in the game; obtaining a wager outcome for the event; and transmitting the wager outcome to the player's device.

In one embodiment, the obtaining of the wager outcome for the event further includes calculating, as the wager outcome, a credit amount to be added or subtracted from a wagered amount using at least one of a random number generator or a pay table.

In one embodiment, the processor-executable instructions further comprising: allocating one or more game world resources regarding the game.

According to aspects of embodiments of the present invention, a gaming system includes: at least one processor; a memory coupled to the at least one processor, the memory storing processor-executable instructions executed by the at least one processor, the processor-executable instructions comprising: instantiating a regulated game world operating system (GW.OS), a regulated real world operating system (RC.OS), an unregulated GW.OS, and an unregulated RC.OS; receiving a request for a gaming session from a player's device, the request comprising location information of the player's device; associating the regulated GW.OS with the gaming session based on a geographical location of the player's device being in a jurisdiction allowing real currency gaming; receiving a request from the player's device to conduct a real currency wager; instructing, by the regulated GW.OS, the regulated RC.OS to conduct the real currency wager; providing a real currency wager outcome of the real currency wager from the regulated RC.OS to the regulated GW.OS; and allocating game world resources to the gaming session based on the real currency wager outcome.

In one embodiment, the processor-executable instructions further include: receiving a request to conduct a virtual currency wager from the player's device; and associating the unregulated GW.OS with the gaming session.

In one embodiment, the processor-executable instructions further include: conducting the virtual currency wager by the unregulated RC.OS; providing a virtual currency wager outcome of the virtual currency wager from the unregulated RC.OS to the unregulated GW.OS; and reallocating, by the unregulated GW.OS, the game world resources to the gaming session based on the virtual currency wager outcome.

In one embodiment, the memory further includes a patron authorization database, and the processor-executable instructions comprising: storing a record of the regulated GW.OS being associated with the gaming session in the patron authorization database.

In one embodiment, the allocating of the game world resources to the gaming session based on the wager outcome further includes providing a signal to the player's device including a credit amount to be added or subtracted from a wagered amount using at least one of a random number generator or a pay table.

In one embodiment, the processor-executable instructions further comprise performing the allocating of the game world resources to the gaming session based on the real currency wager outcome by the unregulated GW.OS.

According to aspects of embodiments of the present invention, in a method of operating a gaming system, the method includes: instantiating, by one or more processors, a regulated game world operating system (GW.OS), a regulated real world operating system (RC.OS), an unregulated GW.OS, and an unregulated RC.OS; receiving, by the one or more processors, a request for a gaming session from a player's device, the request comprising location information of the player's device; associating, by the one or more processors, the regulated GW.OS with the gaming session based on a geographical location of the player's device being in a jurisdiction allowing real currency gaming; receiving, by the one or more processors, a request from the player's device to conduct a real currency wager; instructing, by the one or more processors and the regulated GW.OS, the regulated RC.OS to conduct the real currency wager; providing, by the one or more processors, a real currency wager outcome of the real currency wager from the regulated RC.OS to the regulated GW.OS; and allocating, by the one or more processors, game world resources to the gaming session based on the real currency wager outcome.

In one embodiment, the method further includes: receiving, by the one or more processors, a request to conduct a virtual currency wager from the player's device; and associating, by the one or more processors, the unregulated GW.OS with the gaming session.

In one embodiment, the method further includes: conducting, by the one or more processors, the virtual currency wager using the unregulated RC.OS; providing, by the one or more processors, a virtual currency wager outcome of the virtual currency wager from the unregulated RC.OS to the unregulated GW.OS; and reallocating, by the one or more processors and the unregulated GW.OS, the game world resources to the gaming session based on the virtual currency wager outcome.

In one embodiment, the method further includes: storing, by the one or more processors, a record of the regulated GW.OS being associated with the gaming session in a patron authorization database.

In one embodiment, the allocating of the game world resources to the gaming session based on the wager outcome further comprises providing, by the one or more processors, a signal to the player's device comprising a credit amount to be added or subtracted from a wagered amount using at least one of a random number generator or a pay table.

In one embodiment, the allocating of the game world resources to the gaming session based on the real currency wager outcome is performed by the unregulated GW.OS.

In one embodiment, the location information includes global positioning system (GPS) data of the player's device or network access point information of the player's device, and the method further includes: determining, by the one or more processors, the geographical location of the player's device based on the GPS data or the network access point information.

According to aspects of embodiments of the present invention, in a non-transitory processor-readable storage medium having stored processor-executable instructions for a gaming system, the processor-executable instructions include: instantiating a regulated game world operating system (GW.OS), a regulated real world operating system (RC.OS), an unregulated GW.OS, and an unregulated RC.OS; receiving a request for a gaming session from a player's device, the request comprising location information of the player's device; associating the regulated GW.OS with the gaming session based on a geographical location of the player's device being in a jurisdiction allowing real currency gaming; receiving a request from the player's device to conduct a real currency wager; instructing, by the regulated GW.OS, the regulated RC.OS to conduct the real currency wager; providing a real currency wager outcome of the real currency wager from the regulated RC.OS to the regulated GW.OS; and allocating game world resources to the gaming session based on the real currency wager outcome.

In one embodiment, the processor-executable instructions further include: receiving a request to conduct a virtual currency wager from the player's device; and associating the unregulated GW.OS with the gaming session.

In one embodiment, the processor-executable instructions further include: conducting the virtual currency wager by the unregulated RC.OS; providing a virtual currency wager outcome of the virtual currency wager from the unregulated RC.OS to the unregulated GW.OS; and reallocating, by the unregulated GW.OS, the game world resources to the gaming session based on the virtual currency wager outcome.

In one embodiment, the processor-executable instructions further include: storing a record of the regulated GW.OS being associated with the gaming session in a patron authorization database.

In one embodiment, the allocating of the game world resources to the gaming session based on the wager outcome further includes providing a signal to the player's device including a credit amount to be added or subtracted from a wagered amount using at least one of a random number generator or a pay table.

In one embodiment, the processor-executable instructions further include: performing the allocating of the game world resources to the gaming session based on the real currency wager outcome by the unregulated GW.OS.

In one embodiment, the location information comprises global positioning system (GPS) data of the player's device or network access point information of the player's device, and the processor-executable instructions further include: determining the geographical location of the player's device based on the GPS data or the network access point information.

According to aspects of embodiments of the present invention, a gaming system includes: at least one processor; a memory coupled to the at least one processor, the memory storing processor-executable instructions executed by the at least one processor, the processor-executable instructions including: receiving location information from a player's device; determining a geographical location of the player's device based on the location information; selecting a game world control layer control logic based on the geographical location; and coupling the player's device to a game server based on the game world control layer control logic that is selected.

In one embodiment, when the geographical location of the player's device is in a jurisdiction allowing real currency wagers, the game server is a real currency game server configured to initiate a real currency wager.

In one embodiment, when the geographical location of the player's device is in a jurisdiction not allowing real currency wagers, the game server is a virtual currency game server configured to initiate a virtual currency wager.

In one embodiment, the location information comprises global positioning system (GPS) data of the player's device or network access point information of the player's device; and the determining of the geographical location of the player's device further includes determining the geographical location of the player's device based on the GPS data or the network access point information.

In one embodiment, the processor-executable instructions further include providing the selected game world control layer control logic to the player's device.

In one embodiment, the processor-executable instructions further include: selecting an entertainment game control logic based on the geographical location; and providing the entertainment game control logic to the player's device.

According to aspects of embodiments of the present invention, in a method of operating a gaming system, the method includes: receiving, by one or more processors, location information from a player's device; determining, by the one or more processors, a geographical location of the player's device based on the location information; selecting, by the one or more processors, a game world control layer control logic based on the geographical location; and coupling, by the one or more processors, the player's device to a game server based on the game world control layer control logic that is selected.

In one embodiment, when the geographical location of the player's device is in a jurisdiction allowing real currency wagers, the game server is a real currency game server configured to initiate a real currency wager.

In one embodiment, when the geographical location of the player's device is in a jurisdiction not allowing real currency wagers, the game server is a virtual currency game server configured to initiate a virtual currency wager.

In one embodiment, the location information includes global positioning system (GPS) data of the player's device or network access point information of the player's device; and the determining of the geographical location of the player's device further includes determining, by the one or more processors, the geographical location of the player's device based on the GPS data or the network access point information.

In one embodiment, the method further includes: providing, by the one or more processors, the selected game world control layer control logic to the player's device.

In one embodiment, the method further includes: selecting, by the one or more processors, an entertainment game control logic based on the geographical location; and providing, by the one or more processors, the entertainment game control logic to the player's device.

In one embodiment, the game world control layer control logic is configured to access a game server enabled for real currency gaming based on the geographical location of the player's device being in a jurisdiction allowing real currency wagers.

According to aspects of embodiments of the present invention, in a non-transitory processor-readable storage medium having stored processor-executable instructions for a gaming system, the processor-executable instructions comprising: receiving location information from a player's device; determining a geographical location of the player's device based on the location information; selecting a game world control layer control logic based on the geographical location; and coupling the player's device to a game server based on the game world control layer control logic that is selected.

In one embodiment, when the geographical location of the player's device is in a jurisdiction allowing real currency wagers, the game server is a real currency game server configured to initiate a real currency wager.

In one embodiment, when the geographical location of the player's device is in a jurisdiction not allowing real currency wagers, the game server is a virtual currency game server configured to initiate a virtual currency wager.

In one embodiment, the location information includes global positioning system (GPS) data of the player's device or network access point information of the player's device; and the determining of the geographical location of the player's device further includes determining the geographical location of the player's device based on the GPS data or the network access point information.

In one embodiment, the processor-executable instructions further include: providing the selected game world control layer control logic to the player's device.

In one embodiment, the processor-executable instructions further include: selecting an entertainment game control logic based on the geographical location; and providing the entertainment game control logic to the player's device.

In one embodiment, the game world control layer control logic is configured to access a game server enabled for real currency gaming based on the geographical location of the player's device being in a jurisdiction allowing real currency wagers.

DETAILED DESCRIPTION

Figure 1:
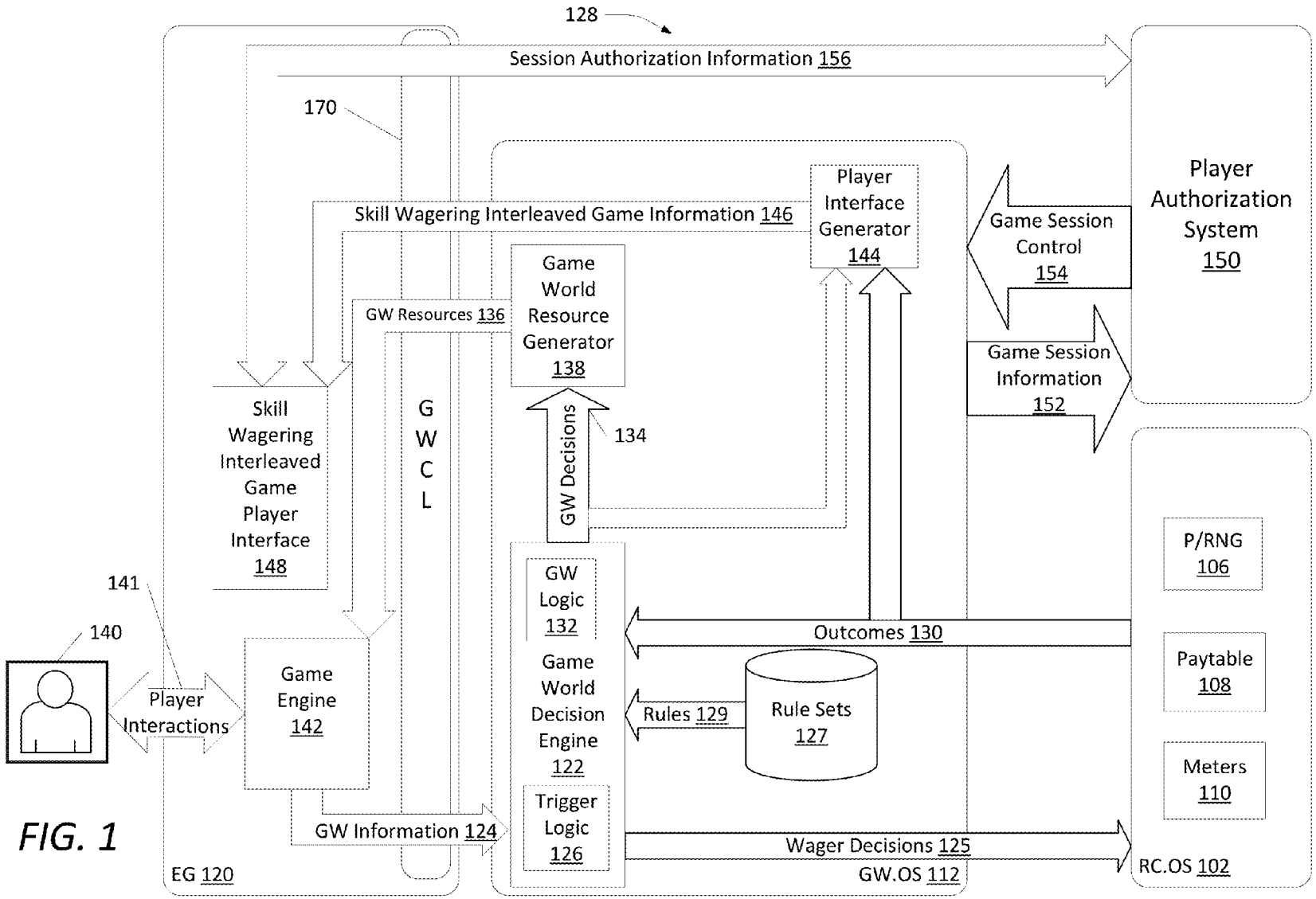
FIG. 1 illustrates a multi-mode multi-jurisdiction skill wagering interleaved game in accordance with an embodiment of the invention.

Turning now to the drawings, systems and methods for operation of multi-mode multi-jurisdiction skill wagering interleaved games (SWigs) are illustrated. In several embodiments, a multi-mode multi-jurisdiction skill wagering interleaved game is a form of a combined skill and wagering game that integrates both a gambling game that includes a real world operating system (RC.OS), which manages the gambling game, as well as a skill-based entertainment game (Eg) coupled to the RC.OS by a game world operating system (GW.OS), which manages the configuration of the multi-mode multi-jurisdiction skill wagering interleaved game entertainment game. The Eg executes the skill-based components of the multi-mode multi-jurisdiction skill wagering interleaved game entertainment game for user entertainment. In certain embodiments, the multi-mode multi-jurisdiction skill wagering interleaved game also includes a player interface associated with either or both the gambling game and the entertainment game. A player's play of a multi-mode multi-jurisdiction skill wagering interleaved game is an electronic representation of player interactions, typically via a player interface, and associated with a player profile of the multi-mode multi-jurisdiction skill wagering interleaved game.

In operation of a multi-mode multi-jurisdiction skill wagering interleaved game, a player acts upon various types of elements of the entertainment game in a game world environment. Elements are a limited resource consumed within an entertainment game to advance entertainment game gameplay. In playing the entertainment game using the elements, a player can (optionally) consume and accrue game world credits (GWCs) within the entertainment game. These credits can be in the form of (but are not limited to) game world credits, experience points, or points generally. Wagers can be made in the gambling game as triggered by the player's use of one or more elements of the entertainment game. The wagers are made using real world credits (RWCs). The real world credits can be credits in an actual currency, or can be credits in a virtual currency, which has real world value. Gambling outcomes from the gambling game can cause consumption, loss, or accrual of RWCs. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWCs for a randomly generated payout of GWCs or a wager of elements for a randomly generated payout of elements. In particular embodiments, an amount of GWCs and/or elements used as part of a wager can have a RWC value if cashed out of a multi-mode multi-jurisdiction skill wagering interleaved game gameplay session.

Example elements include enabling elements (EE), which are elements that enable a player's play of the entertainment game and the consumption of which by the player while playing the entertainment game can trigger a wager in a gambling game. Another non-limiting example of an element is a reserve enabling element (REE), which is an element that converts into one or more enabling elements upon occurrence of a release event in skill wagering interleaved game gameplay. Other types of elements include actionable elements (AE), which are elements that are acted upon to trigger a wager in the gambling game and may or may not be restorable during normal play of the entertainment game. Another type of element is a common enabling element (CEE), which is an element that may be shared by two or more players and the use of which by any of the players causes a wager to be triggered.

In progressing through entertainment game gameplay, elements can be utilized by a player during interactions with a controlled entity (CE), which is a character, entity, inanimate object, device, or other object under control of a player.

Also, entertainment game gameplay progress and wager triggers can be dependent upon a game world variable such as, but not limited to: a required game object (RGO), which is a specific game object in an entertainment game acted upon for an AE to be completed (such as, but not limited to, a specific key needed to open a door); a required environmental condition (REC), which is a game state present within an entertainment game for an AE to be completed (such as, but not limited to, daylight, the presence of which enables a character to walk through woods); or a controlled entity characteristic (CEC), which is a status of the CE within an entertainment game for an AE to be completed (such as but not limited to a CE to have full health points before entering battle). Although various gameplay or game world resources, such as, but not limited to, GWCs, RWCs, and elements as discussed above, any gameplay resource can be utilized to advance multi-mode multi-jurisdiction skill wagering interleaved game gameplay as well as form the basis for a trigger of a wager as appropriate to the specification of a specific application in accordance with various embodiments of the invention. Various skill wagering interleaved games are discussed in Patent Cooperation Treaty Application No. PCT/US11/26768, filed Mar. 1, 2011, entitled ENRICHED GAME PLAY ENVIRONMENT (SINGLE and/or MULTI-PLAYER) FOR CASINO APPLICATIONS and Patent Cooperation Treaty Application No. PCT/US11/63587, filed Dec. 6, 2011, entitled ENHANCED SLOT-MACHINE FOR CASINO APPLICATIONS, each disclosure of which is hereby incorporated by reference in its entirety.

In many embodiments, a multi-mode multi-jurisdiction skill wagering interleaved game integrates a multi-mode multi-jurisdiction skill wagering interleaved game entertainment game with a gambling game. In several embodiments, a multi-mode multi-jurisdiction skill wagering interleaved game can utilize a GW.OS to monitor multi-mode multi-jurisdiction skill wagering interleaved game entertainment game gameplay executed by an Eg for a gambling event occurrence. The gambling event occurrence can be detected from the skillful execution of the multi-mode multi-jurisdiction skill wagering interleaved game entertainment game in accordance with at least one gambling event occurrence rule. The gambling event occurrence can be communicated to a RC.OS, where the gambling event occurrence triggers a RWC wager made in accordance with a wager trigger rule within the gambling game executed by the RC.OS. The wager can produce a wager payout as a randomly generated payout of both RWC and gameplay resources. In addition, a multi-mode multi-jurisdiction skill wagering interleaved game entertainment game gameplay modification can be generated by the GW.OS that can be used to modify multi-mode multi-jurisdiction skill wagering interleaved game entertainment game gameplay executed by the Eg based upon the wager payout. In various embodiments, multi-mode multi-jurisdiction skill wagering interleaved game entertainment game gameplay can advance through the performance of multi-mode multi-jurisdiction skill wagering interleaved game player actions, where a multi-mode multi-jurisdiction skill wagering interleaved game player action is an action during multi-mode multi-jurisdiction skill wagering interleaved game gameplay that can be performed by a player or to a player.

In several embodiments, a gambling event occurrence can be determined from one or more game world variables within a multi-mode multi-jurisdiction skill wagering interleaved game entertainment game that are used to trigger a wager in a gambling game. Game world variables can include, but are not limited to, passage of a period of time during multi-mode multi-jurisdiction skill wagering interleaved game entertainment game gameplay, a result from a multi-mode multi-jurisdiction skill wagering interleaved game entertainment game gameplay session (such as, but not limited to, achieving a goal or a particular score), a player action that is a consumption of an element, or a player action that achieves a combination of elements to be associated with a player profile.

In numerous embodiments, an entertainment game modification is an instruction of how to modify multi-mode multi-jurisdiction skill wagering interleaved game entertainment game gameplay resources based upon one or more of a gambling game payout and game world variables. An entertainment game modification can modify any aspect of a multi-mode multi-jurisdiction skill wagering interleaved game entertainment game, such as, but not limited to, an addition of a period of time available for a current multi-mode multi-jurisdiction skill wagering interleaved game entertainment game gameplay session, an addition of a period of time available for a future multi-mode multi-jurisdiction skill wagering interleaved game entertainment game gameplay session, or any other modification to elements that can be utilized in multi-mode multi-jurisdiction skill wagering interleaved game entertainment game gameplay. In certain embodiments, an entertainment game modification can modify a type of element, the consumption of which triggers a gambling event occurrence. In particular embodiments, an entertainment game modification can modify a type of element, the consumption of which is not required in a gambling event occurrence.

In a number of embodiments, a skill wagering interleaved game player interface 148 can be utilized that depicts a status of the multi-mode multi-jurisdiction skill wagering interleaved game entertainment game. The player interface 148 can depict any aspect of a multi-mode multi-jurisdiction skill wagering interleaved game entertainment game including, but not limited to, an illustration of multi-mode multi-jurisdiction skill wagering interleaved game entertainment game gameplay advancement as a player plays the multi-mode multi-jurisdiction skill wagering interleaved game.

In some embodiments, a player authorization system 150 is used to authorize a SWig gaming session. The player authorization system 150 receives game session information 152, that may include, but is not limited to, player, Eg, GW.OS, and RC.OS information from the GW.OS 112. The player authorization system uses the player, Eg, GW.OS, and RC.OS information to regulate a SWig gaming session. In some embodiments, the player authorization system 150 may also assert control of a SWig game session 154. Such control may include, but is not limited to, ending a SWig game session, initiating gambling in a SWig game session, ending gambling in SWig game session but not ending a player's play of the entertainment game portion of the SWig game, and changing from real credit wagering in a SWig to virtual credit wagering, or vice versa.

Multi-Mode Multi-Jurisdiction Skill Wagering Interleaved Games

In many embodiments, a multi-mode multi-jurisdiction skill wagering interleaved game integrates high-levels of entertainment content with a game of skill (multi-mode multi-jurisdiction skill wagering interleaved game entertainment game) and a gambling experience with a game of chance (gambling game). A multi-mode multi-jurisdiction skill wagering interleaved game provides for random gambling game outcomes independent of player skill, while providing that the user's gaming experience (as measured by obstacles/challenges encountered, time of play and other factors) is shaped by the player's skill. A multi-mode multi-jurisdiction skill wagering interleaved game 128 in accordance with an embodiment of the invention is illustrated in FIG. 1. The multi-mode multi-jurisdiction skill wagering interleaved game 128 includes an RC.OS 102, and a GW.OS 112. The RC.OS 102 is connected with the GW.OS 112. The Eg 120 is also connected with the GW.OS 112.

In several embodiments, the RC.OS 102 is the operating system for the gambling game of the multi-mode multi-jurisdiction skill wagering interleaved game 128 and controls and operates the gambling game. The operation of a gambling game is enabled by RWC, such as money or other real world funds. A gambling game can increase or decreases an amount of RWC based on random gambling game outcomes, where the gambling proposition of a gambling game is typically regulated by gaming control bodies. In many embodiments, the RC.OS includes a pseudo random or random number generator (P/RNG) 106, one or more real-world credit pay tables 108, RWC meters 110 and other software constructs that enable a game of chance to offer a fair and transparent gambling proposition, and the auditable systems and functions that can enable the game to obtain gaming regulatory body approval.

P/RNG 106 includes software and/or hardware and/or processes, which are used to generate random or pseudo random outcomes. The one or more pay tables 108 are tables that can be used in conjunction with P/RNG 106 to determine an amount of RWCs earned as a function of multi-mode multi-jurisdiction skill wagering interleaved game gameplay and are analogous to the pay tables used in a conventional slot machine. There can be one or a plurality of pay tables 108 in the RC.OS and used to implement one or more gambling games, the selection of which can be determined by factors including (but not limited to) game progress a player has earned, and/or bonus rounds which a player can be eligible for. RWCs are credits analogous to slot machine game credits, which are entered into a skill wagering interleaved game by the user, either in the form of money such as hard currency or electronic funds. RWCs can be decremented or augmented based on the outcome of the P/RNG 106 according to the pay table pay table 108, independent of player skill. In certain embodiments, an amount of RWC can be used as criteria in order to enter higher multi-mode multi-jurisdiction skill wagering interleaved game entertainment game levels. RWCs can be carried forward to higher game levels or paid out if a cash out is opted for by a player. The amount of RWCs used to enter a specific level of the game level need not be the same for each level.

In many embodiments, the GW.OS 112 manages the overall multi-mode multi-jurisdiction skill wagering interleaved game operation, with the RC.OS 102 and the Eg 120 being support units to the GW.OS 112. In several embodiments, the GW.OS 112 may include mechanical, electronic, and software systems for a multi-mode multi-jurisdiction skill wagering interleaved game entertainment game. The GW.OS 112 provides an interface between multi-mode multi-jurisdiction SWig Eg 120 and the RC.OS 102 implementing the multi-mode multi-jurisdiction skill wagering interleaved game gambling game. The GW.OS 112 includes a game world decision engine 122 that receives game world information 124 from the Eg 120. The game world decision engine 122 uses the game world information, along with trigger logic 126 to make wagering decisions 125 about triggering a wager of RWC in the RC.OS 102. In some embodiments, the trigger logic includes a rules engine that utilizes trigger decision logic encoded in one or more rules 129. Various rules engine algorithms may be used within the rules engine, including but not limited to a Rete algorithm. In many embodiments, a plurality of rule sets are stored in a rule set data store 127, such as but not limited to a data store organized as a database. In some embodiments, the rule sets include, but are not limited to, rule sets that are specific to a particular jurisdiction and determine whether or not the GW.OS 112 may make real money wagering decisions. Real money may include official currencies of a particular nation or region (e.g., U.S. dollars, Euros, Canadian dollars, pounds sterling, etc.), virtual digital currency (e.g., bitcoin), or other types of currency credits that can be traded for currency or used as a medium of exchange for goods and services in a commerce system.

The game world information 124 includes, but is not limited to, game world variables from the Eg 120 that indicate the state of the Eg 120 and the entertainment game that is being played by a player 140 and player actions and interactions 141 between the player 140 and the Eg 120. The wager information may include, but is not limited to, an amount of RWC to be wagered, a trigger of a gambling game and a selection of a pay table 108 to be used by the gambling game.

In some embodiments, the game world decision engine 122 also receives gambling game outcomes 130 from the RC.OS 102. The game world decision engine 122 uses the gambling game outcomes 130, in conjunction with a the game world information 124 and game world logic 132 to make game world decisions 134 about what kind of game world resources 136 are to be provided to the Eg 120. A game world resource generator 138 generates the game world resources 136 based on the game world decisions 134 made by the game world decision engine 122 and transmits them to the Eg 120.

In various embodiments, the game world decision engine also calculates how much of the GWCs to award to the player 140 based at least in part on the player's skillful execution of the entertainment game of the multi-mode multi-jurisdiction skill wagering interleaved game as determined from the game world information 124. In some embodiments, gambling game outcomes 130 are also used to determine how much of the GWCs should be awarded to the player 140.

In some embodiments, the game world logic 132 utilizes a rules engine decision logic encoded in one or more rules 129. Various rules engine algorithms may be used within the rules engine, including but not limited to a Rete algorithm. In many embodiments, a plurality of rule sets are stored in a rule set data store 127, such as but not limited to a data store organized as a database. In some embodiments, the rule sets include, but are not limited to, rule sets that define what game world resources may be transmitted to the entertainment game from the GW.OS 112 based on wagering or gambling game outcomes 130 and game world information 124.

In some embodiments, the game world decisions 134 and gambling game outcomes 130 are provided to a player interface generator 144. The player interface generator 144 receives the game world decisions 134 and gambling game outcomes 130 and generates multi-mode multi-jurisdiction skill wagering interleaved game information 146 describing the state of the multi-mode multi-jurisdiction skill wagering interleaved game. The multi-mode multi-jurisdiction skill wagering interleaved game information 146 includes, but is not limited to, amounts of GWCs earned, lost, or accumulated by the player 140 through skillful execution of the entertainment game and RWC amounts won, lost, or accumulated as determined from the gambling game outcomes 130 and the RWC meters 110.

The GW.OS 112 can further couple to the RC.OS 102 to determine the amount of RWCs available on the game and other metrics of wagering on the gambling game (and potentially affect the amount of RWCs in play on the RC.OS). The GW.OS 112 additionally may include various audit logs and activity meters. In some embodiments, the GW.OS 112 can also couple to a centralized server for exchanging various data related to the player 140 and their activities on the game. The GW.OS 112 furthermore couples to the Eg 120.

In several embodiments, GWCs are player points earned or depleted as a function of player skill, specifically as a function of player performance in the context of the game. GWCs may be analogous to the score in a typical video game. A multi-mode multi-jurisdiction skill wagering interleaved game entertainment game can have one or more scoring criteria, embedded within the GW.OS 112 or the Eg 120 that reflect player performance against the goal(s) of the multi-mode multi-jurisdiction skill wagering interleaved game entertainment game. In some embodiments, GWCs can be carried forward from one level of sponsored gameplay to another. In many embodiments, GWCs can be used within the Eg 120 to purchase in game items, including, but not limited to, elements that have particular properties, power ups or the like. In other embodiments, GWCs may be used to earn entrance into a sweepstakes drawing, or earning participation in, or victory in, a tournament with prizes. In many embodiments, GWCs can be stored on a player tracking card or in a network-based player tracking system, where the GWCs are attributed to a specific player.

In certain embodiments, the operation of the GW.OS 112 does not affect the gambling operation of the RC.OS 112, except for player choice parameters that are allowable in slot machines including, but not limited to, wager terms such as but not limited to a wager amount, how fast the player wants to play (for example, by pressing a button or pulling the handle of a slot machine), and/or agreement to wager into a bonus round. In this sense, the RC.OS 102 provides a fair and transparent, non-skill based gambling proposition co-processor to the GW.OS 112. In the illustrated embodiment, the transfer of game world information 124 shown between the GW.OS 112 and the RC.OS 102 allow the GW.OS 112 to obtain information from the RC.OS 102 as to the amount of RWCs available in the gambling game. In various embodiments, the communication links can also convey a status operation of the RC.OS 102 (such as on-line or tilt). In numerous embodiments, the communication links can further communicate the various gambling control factors, which the RC.OS 102 uses as input, such as the number of RWCs consumed per game or the player's election to enter a jackpot round. In FIG. 1, the GW.OS 112 is also shown as connecting to the player's player interface directly, as this can be utilized to communicate certain multi-mode multi-jurisdiction skill wagering interleaved game entertainment game club points, player status, control the selection of choices and messages, which a player can find useful in order to adjust the a multi-mode multi-jurisdiction skill wagering interleaved game entertainment game experience, or understand their gambling status in the RC.OS 102.

In various embodiments, the Eg 120 manages and controls the visual, audio, and player control for the multi-mode multi-jurisdiction skill wagering interleaved game entertainment game. In certain embodiments, the Eg 120 accepts input from the player 140 through a set of hand controls, and/or head, gesture, and/or eye tracking systems and outputs video, audio and/or other sensory output to a player interface. In many embodiments, the Eg 120 can exchange data with and accept control information from the GW.OS 112. In several embodiments an Eg 120 can be implemented using a casino gaming device such as a cabinet based casino game, a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an Eg 120 can be an electromechanical game system of a multi-mode multi-jurisdiction skill wagering interleaved game that is an electromechanical skill wagering interleaved game. An electromechanical skill wagering interleaved game executes an electromechanical game for player entertainment. The electromechanical game can be any game that utilizes both mechanical and electrical components, where the game operates as a combination of mechanical motions performed by at least one player or the electromechanical game itself. Various electromechanical skill wagering interleaved games are discussed in Patent Cooperation Treaty Application No. PCT/US12/58156, filed Sep. 29, 2012, the contents of which are hereby incorporated by reference in their entirety.

The Eg 120 operates mostly independently from the GW.OS 112, except that, via the transfer of game world resources 136, the GW.OS 112 can send certain multi-mode multi-jurisdiction skill wagering interleaved game entertainment game resources including control parameters to the Eg 120 to affect the execution of the Eg 120, such as (but not limited to) changing the difficulty level of the game. In various embodiments, these entertainment game control parameters can be based on a gambling outcome of a gambling game that was triggered by an element in the multi-mode multi-jurisdiction skill wagering interleaved game entertainment game being acted upon by the player. The Eg 120 can accept this input from the GW.OS 112, make adjustments, and continue multi-mode multi-jurisdiction skill wagering interleaved game entertainment game gameplay, all the while running seamlessly from the player's perspective.

Execution of the Eg 120 is mostly skill-based, except for where the Eg's processes can inject complexities into the game by chance in its normal operation to create unpredictability in the multi-mode multi-jurisdiction skill wagering interleaved game entertainment game. The Eg 120 can also communicate player choices made in the game to the GW.OS 112, included in the game world information 124, such as but not limited to the player's utilization of the elements of the Eg 120 during the player's skillful execution of the Eg 120. The GW.OS 112 operates in this architecture, being interfaced thusly to the Eg 120, to allow the transparent coupling of an multi-mode multi-jurisdiction skill wagering interleaved game entertainment game to a fair and transparent random chance gambling game, providing a seamless perspective to the player 140 that they are playing a typical popular multi-mode multi-jurisdiction skill wagering interleaved game entertainment game (which is skill based).

In several embodiments, the RC.OS 102 can accept a trigger to run a gambling game in response to actions taken by the player 140 in the multi-mode multi-jurisdiction skill wagering interleaved game entertainment game as conveyed by the Eg 120 to the GW.OS 112, and as triggered by the GW.OS 112 using trigger logic 126, background to the overall skill wagering interleaved game from the player's perspective, but can provide information to the GW.OS 112 to expose the player 140 to certain aspects of the gambling game, such as (but not limited to) odds, amount of RWCs in play, and amount of RWCs available. In various embodiments, the RC.OS 102 can accept modifications in the amount of RWCs wagered on each individual gambling attempt, or the number of gambling games per minute the RC.OS 102 can execute, entrance into a bonus round, and other factors, all the while these factors can take a different form than that of a typical slot machine. An example of a varying wager amount that the player can choose can include, but is not limited to gameplay using a more difficult Eg level. These choices can increase or decrease the amount wagered per individual gambling game, in the same manner that a standard slot machine player can decide to wager more or fewer credits for each pull of the handle. In several embodiments, the RC.OS 102 can communicate a number of factors back and forth to the GW.OS 112, via an interface, such that an increase/decrease in a wagered amount can be related to the player's decision making as to their player profile in the multi-mode multi-jurisdiction skill wagering interleaved game entertainment game. In this manner, a player can be in control of a per game wager amount, with the choice mapping to a parameter or component that is applicable to the multi-mode multi-jurisdiction skill wagering interleaved game entertainment game experience.

In some embodiments, a game world control layer 170 provides an interface between the game engine 142 and the GW.OS 112. The game world control layer 170 resides on the Eg 120. The game world control layer 170 controls the player interface 148, provides game world information 124 to the GW.OS 112 and receives game world resources 136 from the GW.OS 112. In some embodiments, the game world control layer 170 is supplied to the Eg 120 as a set of application programming interfaces that are integrated into the game engine 142 when the game engine 142 is built. In many embodiments, the game world control layer 170 is a separate dynamically linked library that may be separate from, but called by, the game engine 142 at runtime. In some embodiments, the game world control layer 170 is a separate service that is invoked on the Eg 120 and interfaces to the game engine 142.

In many embodiments, a multi-mode multi-jurisdiction skill wagering interleaved game integrates a video game style gambling machine, where the gambling game (including an RC.OS 102 and RWCs) is not player skill based, while at the same time allows players to use their skills to earn club points, which a casino operator can translate to rewards, tournament opportunities, and prizes for the players. The actual exchange of monetary funds earned or lost directly from gambling against a game of chance in a gambling game, such as a slot machine, is preserved. At the same time a rich environment of rewards to stimulate gamers can be established with the entertainment game. In several embodiments, the multi-mode multi-jurisdiction skill wagering interleaved game can leverage popular titles with gamers and provides a sea change environment for casinos to attract players with games that are more akin to the type of entertainment that a younger generation desires. In various embodiments, players can apply their skill towards building and banking GWCs that in turn can be used to win tournaments and various prizes as a function of their gamer prowess. Numerous embodiments minimize the underlying changes applied to the aforementioned entertainment software for the skill wagering interleaved game to operate within a multi-mode multi-jurisdiction skill wagering interleaved game entertainment game construct. Therefore, a plethora of complex game titles and environments can be rapidly and inexpensively to deployed in a gambling environment.

In certain embodiments, multi-mode multi-jurisdiction skill wagering interleaved games also allow players to gain entry into subsequent competitions through the accumulation of GWCs as a function of the user's demonstrated skill at the game. These competitions can pit individual players or groups of players against one another and/or against the operator of a gambling game (such as, but not limited to, a casino) to win prizes based upon a combination of chance and skill. These competitions can be either asynchronous events, whereby players participate at a time and/or place of their choosing, or they can be synchronized events, whereby players participate at a specific time and/or venue.

In many embodiments, one or more players can be engaged in playing a skill based multi-mode multi-jurisdiction skill wagering interleaved game entertainment game executed by the Eg 120. A multi-mode multi-jurisdiction skill wagering interleaved game can include an entertainment game that includes head-to-head play between a single player and the computer, between two or more players against one another, or multiple players playing against the computer and/or each other, as well as a process by which a player can bet on the outcome of a multi-mode multi-jurisdiction skill wagering interleaved game entertainment game. The multi-mode multi-jurisdiction skill wagering interleaved game entertainment game can also be a game where the player is not playing against the computer or any other player, such as in games where the player is effectively playing against himself or herself.

In accordance with some embodiments, the use of the GW.OS, RC.OS and Eg allows for the separation of control of a multi-mode multi-jurisdiction skill wagering interleaved game between different devices. For example, the Eg may be hosted by a device that is separate from any devices that host the RC.OS and/or GW.OS. Through separation of control of the functions of the GW.OS, RC.OS and Eg, the RC.OS may be isolated from the player's device, thus preventing player interference with the RC.OS and the gambling game. In addition, as the Eg is responsible for providing the entertainment game, multi-mode multi-jurisdiction skill wagering interleaved games may provide for complex entertainment games for the player as the Eg need not include the tightly regulated components of the RC.OS, thus providing for more freedom in Eg design. Also, separation of control allows a GW.OS to provide complex wager initiation rules that would not be possible if the either the Eg or the RC.OS were to be in control of the wager initiation.

In accordance with various embodiments, a multi-mode multi-jurisdiction skill wagering interleaved game allows for interleaving of continuous wagering within an entertainment game. For example, instead of wagering once, and then playing an entertainment game to completion, or playing an entertainment game to completion and then placing a wager, a multi-mode multi-jurisdiction skill wagering interleaved game allows a gaming system or device to be provided to a player where the gaming system or device provides a complex and interesting entertainment game with wagering incorporated throughout the entertainment game.

In various embodiments, a multi-mode multi-jurisdiction skill wagering interleaved game provides for feedback into the entertainment game of additional entertainment game resources that are made available in the Eg for the use of the player as the result of wagering outcomes. The additional entertainment game resources may enable portions of the entertainment game that were not available to the player without the resources.

In many embodiments, a multi-mode multi-jurisdiction skill wagering interleaved game provides the ability to use the gambling hybrid game in more than one jurisdiction, as the Eg is a component separate from the GW.OS and RC.OS. For example, the Eg may be operated as either a pure entertainment game, or as a gambling game depending on the type of characteristics of the RC.OS that the Eg is coupled to.

In some embodiments, a multi-mode multi-jurisdiction skill wagering interleaved game provides for display of an entertainment game on a player's device that the player is using to interact with the entertainment game, as well as providing a separate display of a state of a gambling game on a separate gambling game display. The separate gambling game display may be on the player's device within the same physical display device as the entertainment game, on a separate device from the entertainment game having a separate physical screen, or on a separate physical display device separate from the entertainment game on the player's device.

Figure 2:
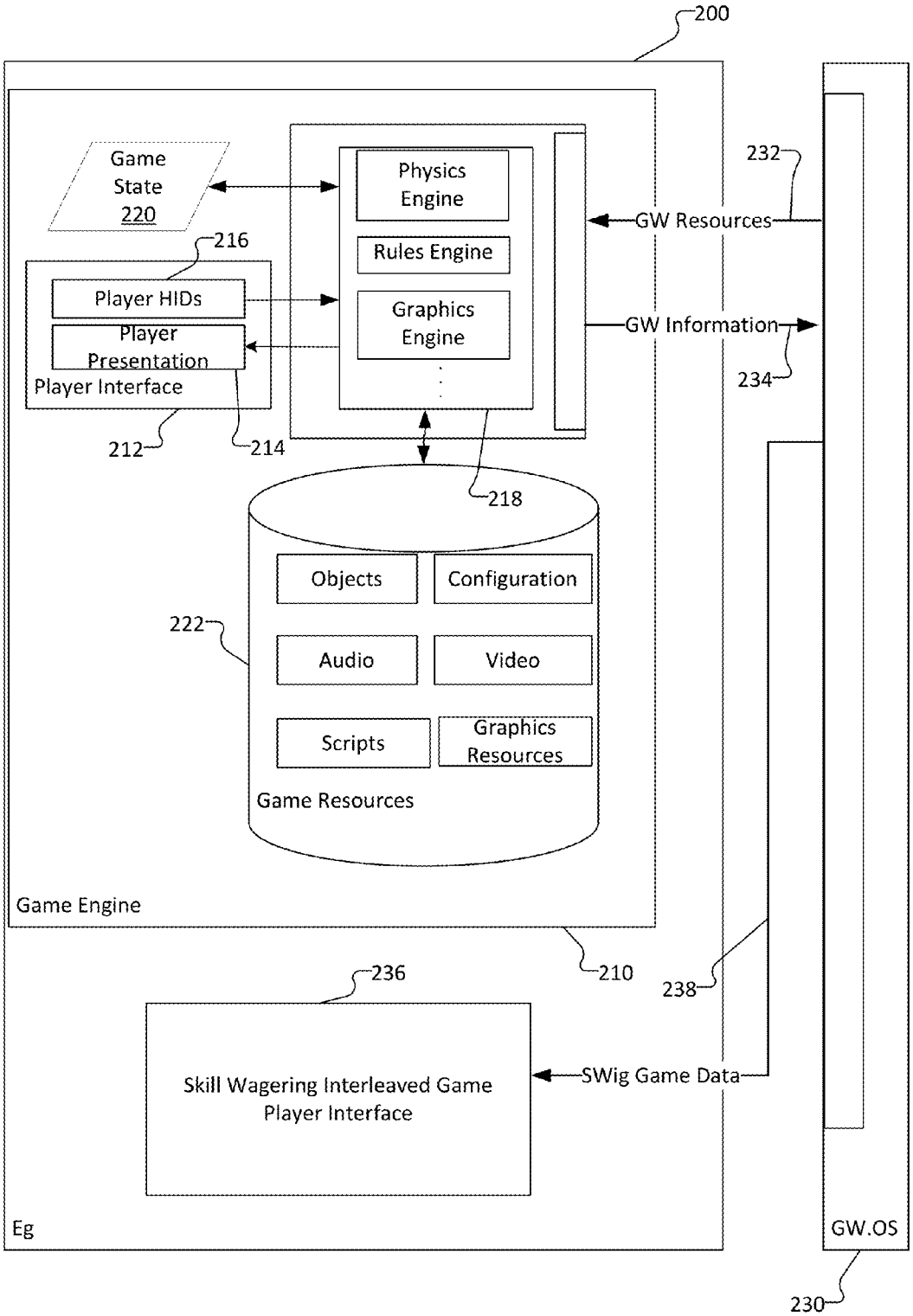
FIG. 2 illustrates an entertainment game in accordance with embodiments of the invention.

FIG. 2 is a diagram of an Eg in accordance with an embodiment of the invention. The Eg 200 may be part of the entertainment game itself, may be a software module that is executed by the entertainment game, or may provide an execution environment for the entertainment game for a particular host. The Eg 200 and an associated entertainment game are hosted by an Eg device. The Eg device is a computing device that is capable of hosting the Eg 200. Embodiments of devices include, but are not limited to, electronic gaming machines, video game consoles, smart phones, personal computers, tablet computers, or the like. In several embodiments, an Eg 200 of a multi-mode multi-jurisdiction skill wagering interleaved game includes a game engine 210 that generates a player interface 212 for interaction with by a player. The player interface 212 includes a player presentation 214 that is presented to a player through the player interface 212. The player presentation may be audio, visual, or tactile, or any combination of such. The player interface 212 further includes one or more human input devices (HIDs) 216 that the player uses to interact with the multi-mode multi-jurisdiction skill wagering interleaved game. Various components or sub-engines 218 of the game engine 210 read data from a game state 220 in order to implement the features of the Eg 200. In some embodiments, components of the game engine 210 include, but are not limited to, a physics engine used to simulate physical interactions between virtual objects in the game state, a rules engine for implementing the rules of the Eg 200, an RNG that may be used for influencing or determining certain variables and/or outcomes to provide a randomizing influence on game play, a graphics engine used to generate a visual representation of the game state to the player, and an audio engine to generate audio outputs for the player interface.

During operation, the game engine 210 reads and writes game resources 222 stored on a data store of the Eg host. The game resources include game objects having graphics and/or control logic used to implement game world objects of the Eg 200. In various embodiments, the game resources may also include, but are not limited to, video files that are used to generate cut-scenes for the Eg 200, audio files used to generate music, sound effects, etc., within the Eg 200, configuration files used to configure the features of the Eg 200, scripts or other types of control code used to implement various game play features of the Eg 200, and graphics resources such as textures, objects, etc., that are used by the game engine 210 to render objects displayed in Eg 200.

In operation, components of the game engine 210 read portions of the game state and generate the player presentation for the player, which is presented to the player using the player interface 212. The player perceives the presentation and provides player inputs using the HIDs 216. The corresponding player inputs are received as player actions or inputs by various components of the game engine 210. The game engine 210 translates the player actions into interactions with the virtual objects of the game world stored in the game state. Components of the game engine 210 use the player interactions with the virtual objects of the entertainment game and the entertainment game state to update the game state and update the presentation presented to the user. The process loops in a game loop continuously while the player plays the multi-mode multi-jurisdiction skill wagering interleaved game.

The Eg 200 includes one or more interfaces between an Eg 200 and other components of a multi-mode multi-jurisdiction skill wagering interleaved game, such as a GW.OS 230. The Eg 200 and the other multi-mode multi-jurisdiction skill wagering interleaved game components communicate with each other using the interfaces, such as by passing various types of data and sending and receiving messages, status information, commands and the like. In certain embodiments, the Eg 200 and GW.OS 230 exchange game world resources 232 and game world (GW) information 234. In some embodiments, the communications include requests by the GW.OS 230 that the Eg 200 update the game state 220 using information provided by the GW.OS 230. Another embodiment of a communication is requesting by the GW.OS 230 that the Eg 200 update one or more game resources using information provided by the GW.OS 230. In another embodiment, communication is provided by the Eg 200 of all or a portion of the game state. In some embodiments, the Eg 200 may also provide one or more of the game resources to the GW.OS 230. In some embodiments, the communication includes player actions that the Eg 200 communicates to the GW.OS 230. The player actions may be low level player interactions with the player interface, such as manipulation of an HID 216, or may be high level interactions with objects as determined by the entertainment game. The player actions may also include resultant actions such as modifications to the multi-mode multi-jurisdiction skill wagering interleaved game state or game resources resulting from the player's actions taken in the multi-mode multi-jurisdiction skill wagering interleaved game. In some embodiments, player actions include, but are not limited to, actions taken by entities, such as non-payer characters (NPC) of the entertainment game, that act on behalf of, or under the control of, the player.

In some embodiments, the Eg 200 includes a multi-mode multi-jurisdiction skill wagering interleaved game player interface 236 used to communicate multi-mode multi-jurisdiction skill wagering interleaved game data 238 to and from the player. The multi-mode multi-jurisdiction skill wagering interleaved game data 238 includes, but is not limited to, information used by the player to configure gambling game RWC wagers, and information about the gambling game RWC wagers, such as RWC balances and RWC amounts wagered.

Figure 3:
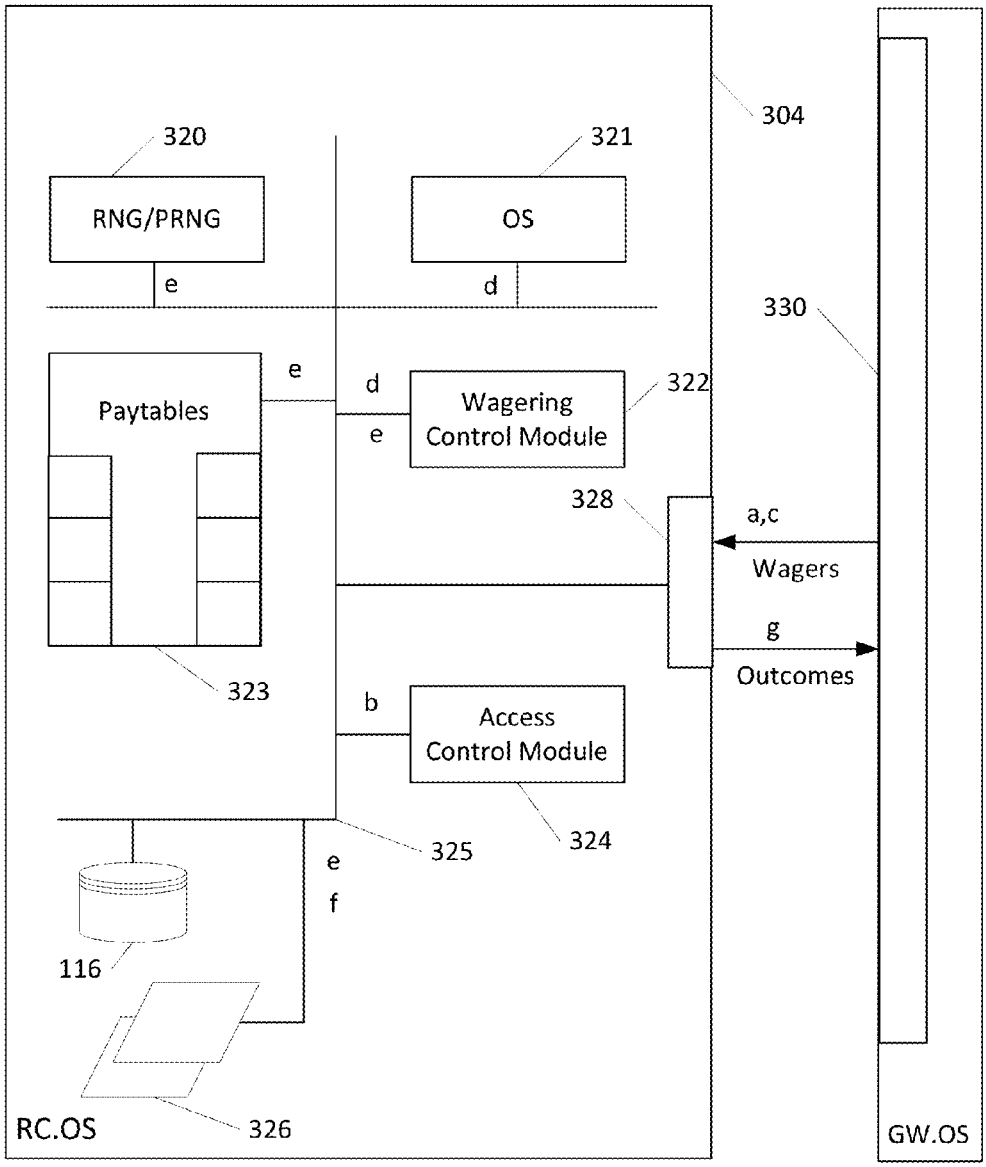
FIG. 3 illustrates a real credit operating system in accordance with embodiments of the invention.

FIG. 3 is an illustration of an RC.OS is accordance with an embodiment of the invention. In this embodiment, the RC.OS 304 has an operating system OS 321, which controls the functions of the RC.OS 304, a random number generator (RNG) 320 to produce random numbers or pseudo random numbers, one or more pay tables 323, which includes a plurality of factors indexed by the random number to be multiplied with an amount of RWC committed in a wager, a wagering control module 322 whose processes may include, but are not limited to, pulling random numbers, looking up factors in the pay tables, multiplying the factors by an amount of RWC wagered, and administering one or more RWC credit meters 326. The RC.OS 304 may also include storage for statuses, wagers, wager outcomes, meters, and other historical events in a storage device 316. An authorization access module 324 provides a process to permit access and command exchange with the RC.OS 304 and access to a repository (a credit meter) 326 for the amount of RWC that a player has deposited in the multi-mode multi-jurisdiction skill wagering interleaved game. An external interface 328 allows the RC.OS 304 to interface to another system or device, such as a GW.OS 330. Various RC.OS modules and components interface with each other via an internal bus 325.

In various embodiments, an RC.OS 304 may use an RNG that is an external system, connected to the RC.OS 304 by local area network (LAN) or a wide area network (WAN) such as the Internet. In some embodiments, the external RNG is a central deterministic system, such as a regulated and controlled random numbered ball selection device, or some other system, which provides random or pseudo random numbers to one or a plurality of connected RC.OSs.

In numerous embodiments, the method of interfacing an RC.OS 304 to other systems/devices or to an external RNG may be the Internet, but it should be noted that nothing would preclude using a different interface than the Internet in certain embodiments, such as a LAN, a USB interface, or some other method by which two electronic devices could communicate with each other.

In numerous embodiments, signaling occurs between various types of an RC.OS 304 and an external system, such as GW.OS 330. In some of these embodiments, the RC.OS 304 operates to manage wagering events and to provide random (or pseudo random) numbers from an RNG. The external system requesting wagering support instructs the RC.OS 304 as to the pay table to use, followed by the amount of RWC to wager. Next, the external system signals the RC.OS 304 to trigger a wager, followed by the RC.OS 304 informing the external system as to the outcome of the wager, the amount of RWC won, and lastly the amount of RWC in the player's account in the credit repository.

In various embodiments, a second communication exchange between various types of RC.OSs and an external system relates to the external system using an RNG result support from the RC.OS. In this exchange, the external system requests an RNG result from the RC.OS, and the RC.OS returns an RNG result, as a function of the RC.OS's internal RNG, or from an RNG external to the RC.OS to which the RC.OS is connected.

In some embodiments, communication exchange between various types of an RC.OS 304 and an external system relate to the external system wanting support on coupling an RNG result to a particular one of the pay tables 323 contained in the RC.OS 304. In such an exchange, the external system instructs the RC.OS 304 as to the pay table 323 to use, and then requests a result whereby the RNG result would be coupled to the requested pay table, and this result would be returned to the external system. In such an exchange, no actual RWC wager is conducted, but might be useful in coupling certain non-RWC wagering entertainment game behaviors and propositions to the same final resultant wagering return which is understood for the multi-mode multi-jurisdiction skill wagering interleaved game to conduct wagering.

In numerous embodiments, some or all of the various commands and responses illustrated could be combined into one or more communication packets.

The following table illustrates a process for operation of the RC.OS:

| SEQUENCE 1 - Place a Wager | |
|---|---|
| a | An external system signals the RC.OS 304 that it wishes to connect to the RC.OS 304 and forwards its credentials. |
| b | The access control module 324 of the RC.OS 304 determines that the external system is safe to connect to and indicates so to the external system |
| c | The external system signals the RC.OS 304 that it wishes the RC.OS 304 to perform a wager and communicates which of the pay tables 323 to use, and the amount of RWC to wager and triggers the wager. |
| d | The OS 321 instructs the wager control module 322 as to the RWC wager and which of the pay tables 323 to select, and to execute. |
| e | The wager control module 322 pulls: an RNG result from the RNG 320, a Pay Table result from the pay tables 323, RWC from the RWC repository 326 as instructed, and applies a random number to the particular one of the pay tables 323 and multiplies the resultant factor from the pay table by the amount of RWC to determine the result of the wager. |
| f | The amount of RWC won in the wager is added to the RWC repository 326. |
| g | The outcome of the wager, and the amount of RWC in the RC.OS 304 and the RWC won is communicated to the external system. |

It should be understood that there may be many embodiments of an RC.OS 304, which could be possible, including forms where many modules and components of the RC.OS 304 are located in various servers and locations, so the foregoing is not meant to be exhaustive or all inclusive, but rather provide information on various embodiments of an RC.OS 304.

Figure 4:
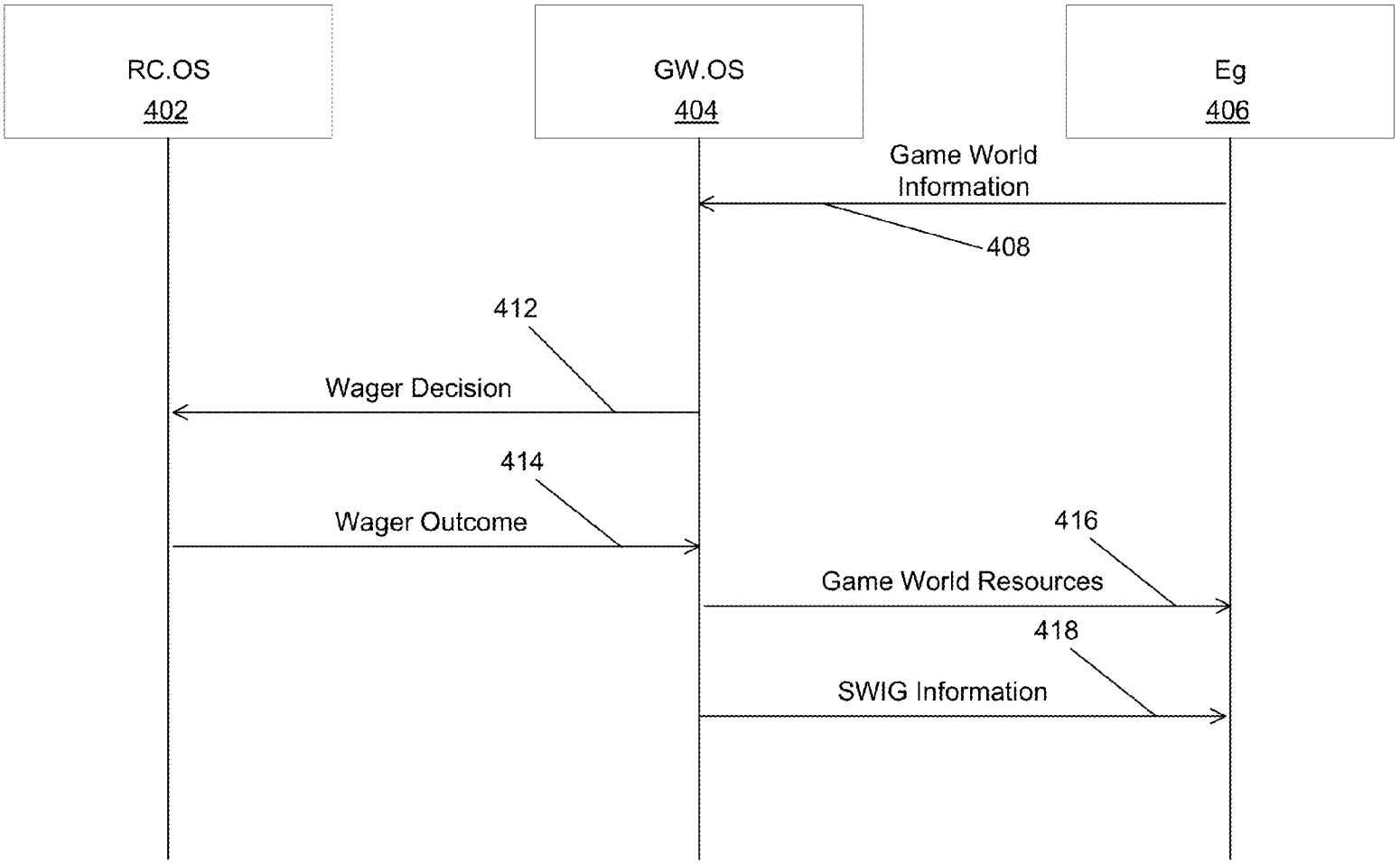
FIG. 4 is a timing diagram that illustrates a process of facilitating interactions between a multi-mode multi-jurisdiction skill wagering interleaved game entertainment game and a multi-mode multi-jurisdiction skill wagering interleaved game gambling game in accordance with embodiments of the invention.
Figure 5A:
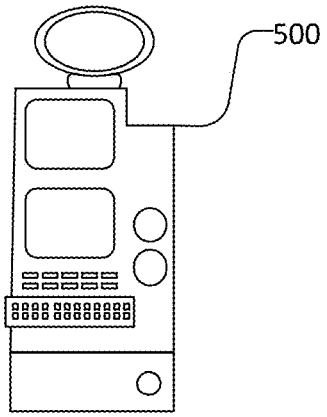
FIGS. 5A, 5B, 5C, and 5D illustrate various devices that host a multi-mode multi-jurisdiction skill wagering interleaved game in accordance with embodiments of the invention.
Figure 5B:
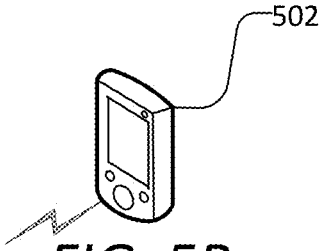
Figure 5C:
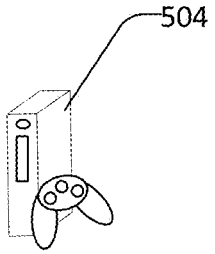
Figure 5D:
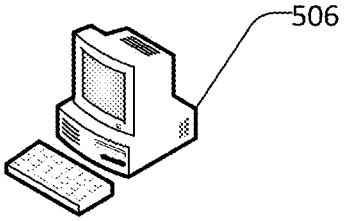

FIG. 4 is a timing diagram that illustrates a process of facilitating interactions between a multi-mode multi-jurisdiction skill wagering interleaved game entertainment game and a gambling game in accordance with embodiments of the invention. The process includes a player performing a player action using a player interface. An Eg 406 can provide a signal (408) to a GW.OS 404 including game world data, including but not limited to a player interaction the Eg 406. In some embodiments, the GW.OS 404 can provide a signal to the Eg 406 as to the amount of EE that will be consumed by the player action in return. The signal can configure a function that controls EE consumption, decay, or addition for the Eg 406. The Eg 406 can, based upon the function, consume an amount of EE designated by the GW.OS 404 to couple to the activity. Upon detection that the player action is a gameplay gambling event, the GW.OS 404 can provide a signal to RC.OS 402 as to the wager terms associated with the gameplay gambling event in a triggered (412) wager. The RC.OS 402 can consume RWC in executing the wager. The RC.OS 402 can return RWC as a payout from the wager. The RC.OS 402 can inform (414) the GW.OS 404 as to the wager outcome such as a payout from the wager. The GW.OS 404 can signal (416) the Eg 406 to ascribe game world resources, such as a payout of EE based upon the wager. The GW.OS 404 can signal the EG 406 the skill wagering interleaved game information (418), such as the payout amount of the wager and credit balance of the player. The Eg 406 can reconcile and combine the payout of EE with the EE already ascribed to the player in the multi-mode multi-jurisdiction skill wagering interleaved game entertainment game. The Eg 406 can also display to the player, using a skill wagering interleaved game player interface the skill wagering interleaved game information as described herein. In various embodiments, the Eg 406 can signal the GW.OS 404 as to its updated status based upon reconciling the payout of EE, and the GW.OS 404 can signal the Eg 406 of a payout of GWC in response to the status update.

In certain embodiments, the sequence of events in the timing diagram of FIG. 4 can be reflected in an entertainment game of a multi-mode multi-jurisdiction skill wagering interleaved game. For example, a player can take an action, such as selecting a number to be placed in a section of a Sudoku board. The Eg 406 can provide a signal (408) to the GW.OS 404 of the player action, such as but not limited to signaling the GW.OS 404 as to the player's choice of the symbol, the position on the Sudoku puzzle board that the symbol is played, and whether or not the symbol as played was a correct symbol in terms of eventually solving the Sudoku puzzle. The GW.OS 404 can process the information concerning the placement of the symbol, and signal (410) to the Eg 406 to consume a symbol (EE) with each placement. The entertainment game then will consume the number (EE) based upon the placement of the symbol. The GW.OS 404 can also signal (412) the RC.OS 402 that 3 credits of RWC are to be wagered to match the placement of the symbol as (EE) that is consumed, on a particular pay table (table Ln-RC). The RC.OS 402 can consume the 3 credits for the wager and execute the specified wager. In executing the wager, the RC.OS 402 can determine that the player hits a jackpot of 6 credits, and allocate the 6 credits of RWC to the credit meter. The RC.OS 402 can also inform (414) the GW.OS 404 that 6 credits of RWC net were won as a payout from the wager. The GW.OS 404 can signal (416) the Eg 406 to add 2 additional symbols (EE) to the symbol of symbols available to a player based upon the gambling game payout. The Eg 406 can then add 2 symbols (EE) to the number of symbol placements available to a player in the skill wagering interleaved game entertainment game. The GW.OS 404 can receive (418) an update from the Eg 406 as to the total amount of EE associated with the player. The GW.OS 404 can log the new player score (GWC) in the game (as a function of the successful placement of the symbol) based on the update, and signal (420) to the Eg 406 to add 2 extra points of GWC to the player's score.

In many embodiments, a player can bet on whether or not the player will beat another player. These bets can be made, for example, on the final outcome of the game, and/or the state of the game along various intermediary points (such as, but not limited to, the score at the end of a period of time of a multi-mode multi-jurisdiction skill wagering interleaved game entertainment game session) and/or on various measures associated with the game. Players can bet against one another, or engage the computer in a head to head competition in the context of their skill level in the multi-mode multi-jurisdiction skill wagering interleaved game entertainment game in question. As such, players can have a handicap associated with their player profile that describes their skill (which can be their professed skill in certain embodiments), and which is used by a GW.OS (such as a local GW.OS or a GW.OS that receives services from remote servers) to offer appropriate bets around the final and/or intermediate outcomes of the multi-mode multi-jurisdiction skill wagering interleaved game entertainment game, and/or to condition sponsored gameplay as a function of player skill, and/or to select players across one or more multi-mode multi-jurisdiction skill wagering interleaved games to participate in head to head games and/or tournaments.

Many embodiments enable the maximization of the number of players able to compete competitively by enabling handicapping of players by utilizing a skill normalization module that handicaps players to even the skill level of players competing against each other. Handicapping enables players of varying performance potential to compete competitively regardless of absolute skill level, such as, but not limited to, where a player whose skill level identifies the player as a beginner can compete in head to head or tournament play against a highly skilled player with meaningful results.

In several embodiments, wagers can be made among numerous multi-mode multi-jurisdiction skill wagering interleaved games with a global betting manager (GBM). The GBM is a system that coordinates wagers that are made across multiple multi-mode multi-jurisdiction skill wagering interleaved games by multiple players. In some implementations, it can also support wagers by third parties relative to the in game performance of other players. The GBM can stand alone, or is capable of being embedded in one of a number of systems, including a GW.OS, Eg, or any remote server capable of providing services to a multi-mode multi-jurisdiction skill wagering interleaved game, or can operate independently on one or a number of servers on-site at a casino, as part of a larger network and/or the Internet or cloud in general.

Although various components of multi-mode multi-jurisdiction skill wagering interleaved games are discussed above, multi-mode multi-jurisdiction skill wagering interleaved games can be configured with any component as appropriate to the specification of a specific application in accordance with embodiments of the invention. In certain embodiments, components of a multi-mode multi-jurisdiction skill wagering interleaved game, such as a GW.OS, RC.OS, Eg can be configured in different ways for a specific multi-mode multi-jurisdiction skill wagering interleaved game gameplay application. Network connected multi-mode multi-jurisdiction skill wagering interleaved games are discussed below.

Stand-Alone Multi-Mode Multi-Jurisdiction Skill Wagering Interleaved Games

FIGS. 5A to 5D illustrate various types of devices that may be used to host a multi-mode multi-jurisdiction skill wagering interleaved game as stand-alone device in accordance with embodiments of the invention. An electronic gaming machine 500 may be used to host a multi-mode multi-jurisdiction skill wagering interleaved game. The electronic gaming machine 500 may be physically located in a casino or other gaming establishment. A portable device 502, such as tablet computer or a smartphone may be used to host a multi-mode multi-jurisdiction skill wagering interleaved game. A gaming console 504 may be used to host a multi-mode multi-jurisdiction skill wagering interleaved game. A personal computer 506 may be used to host a multi-mode multi-jurisdiction skill wagering interleaved game.

Network Connected Multi-Mode Multi-Jurisdiction Skill Wagering Interleaved Games Some multi-mode multi-jurisdiction skill wagering interleaved games in accordance with many embodiments of the invention can operate locally while being network connected to draw services from remote locations or to communicate with other multi-mode multi-jurisdiction skill wagering interleaved games. In many embodiments, operations associated with a multi-mode multi-jurisdiction skill wagering interleaved game utilizing a multi-mode multi-jurisdiction skill wagering interleaved game entertainment game can be performed across multiple devices. These multiple devices can be implemented using a single server or a plurality of servers such that a multi-mode multi-jurisdiction skill wagering interleaved game is executed as a system in a virtualized space, such as (but not limited to) where the RC.OS and GW.OS are large scale centralized servers in the cloud coupled to a plurality of widely distributed Eg controllers or clients via the Internet.

In many embodiments, a RC.OS server can perform certain functionalities of a RC.OS of a multi-mode multi-jurisdiction skill wagering interleaved game. In certain embodiments, a RC.OS server includes a centralized odds engine, which can generate random outcomes (such as but not limited to win/loss outcomes) for a gambling game. The RC.OS server can perform a number of simultaneous or pseudo-simultaneous runs in order to generate random outcomes for a variety of odds percentages that one or more networked multi-mode multi-jurisdiction skill wagering interleaved games can use. In certain embodiments, an RC.OS of a multi-mode multi-jurisdiction skill wagering interleaved game can send information to a RC.OS server including (but not limited to) paytables, maximum speed of play for a gambling game, gambling game monetary denominations, or any promotional RWC provided by the operator of the multi-mode multi-jurisdiction skill wagering interleaved game. In particular embodiments, a RC.OS server can send information to a RC.OS of a multi-mode multi-jurisdiction skill wagering interleaved game including (but not limited to) RWC used in the gambling game, player profile information or play activity and a profile associated with a player.

In several embodiments, a GW.OS server can perform the functionality of the GW.OS across various multi-mode multi-jurisdiction skill wagering interleaved games. These functionalities can include (but are not limited to) providing a method for monitoring high scores on select groups of games, coordinating interactions between gameplay layers, linking groups of games in order to join them in head to head tournaments, and acting as a tournament manager.

In a variety of embodiments, management of player profile information can be performed by a patron management server separate from a GW.OS server. A patron management server can manage information related to a player profile, including (but not limited to) data concerning controlled entities (such as characters used by a player in multi-mode multi-jurisdiction skill wagering interleaved game entertainment game gameplay), game scores, elements, RWC, and GWC associated with particular players and managing tournament reservations. Although a patron management server is discussed separately from a GW.OS server, in certain embodiments a GW.OS server also performs the functions of a patron management server. In certain embodiments, a GW.OS of a multi-mode multi-jurisdiction skill wagering interleaved game can send information to a patron management server including (but not limited to) GWC and RWC used in a game, player profile information, play activity, synchronization information between a gambling game and a multi-mode multi-jurisdiction skill wagering interleaved game entertainment game, or other aspects of a multi-mode multi-jurisdiction skill wagering interleaved game. In particular embodiments, a patron management server can send information to a GW.OS of a multi-mode multi-jurisdiction skill wagering interleaved game including (but not limited to) multi-mode multi-jurisdiction skill wagering interleaved game entertainment game title and type, tournament information, table Ln-GWC tables, special offers, character or profile setup, synchronization information between a gambling game and an multi-mode multi-jurisdiction skill wagering interleaved game entertainment game, or other aspects of a multi-mode multi-jurisdiction skill wagering interleaved game.

In numerous embodiments, an Eg server provides a host for managing head to head play, operating on the network of Egs, which are connected to the Eg server by providing an environment where players can compete directly with one another and interact with other players. Although an Eg server is discussed separately from a GW.OS server, in certain embodiments, the functionalities of an Eg server and GW.OS server can be combined in a single server.

Servers connected via a network to implement multi-mode multi-jurisdiction skill wagering interleaved games in accordance with many embodiments of the invention can communicate with each other to provide services utilized by a multi-mode multi-jurisdiction skill wagering interleaved game. In several embodiments, a RC.OS server can communicate with a GW.OS server. A RC.OS server can communicate with a GW.OS server to communicate any type of information as appropriate for a specific application, including (but not limited to): information used to configure the various simultaneous or pseudo simultaneous odds engines executing in parallel within the RC.OS to accomplish multi-mode multi-jurisdiction skill wagering interleaved game system functionalities, information used to determine metrics of RC.OS performance such as random executions run and outcomes for tracking system performance, information used to perform audits, provide operator reports, and information used to request the results of a random run win/loss result for use of function operating within the GW.OS (such as where automatic drawings for prizes are a function of Eg performance).

In several embodiments a GW.OS server can communicate with an Eg server. A GW.OS server can communicate with an Eg server to communicate any type of information as appropriate for a specific application, including (but not limited to): the management of an Eg server by a GW.OS server during a multi-mode multi-jurisdiction skill wagering interleaved game tournament. Typically, a GW.OS (such as a GW.OS that runs within a multi-mode multi-jurisdiction skill wagering interleaved game or on a GW.OS server) is not aware of the relationship between itself and the rest of a tournament because in a typical configuration the actual tournament play is managed by the Eg server. Therefore, management of a multi-mode multi-jurisdiction skill wagering interleaved game tournament can include (but is not limited to) tasks such as: conducting tournaments according to system programming that can be coordinated by an operator of the multi-mode multi-jurisdiction skill wagering interleaved game; allowing entry of a particular player into a tournament; communicating the number of players in a tournament and the status of the tournament (such as but not limited to the amount of surviving players, their status within the game, time remaining on the tournament); communicating the performance of its players within the tournament; communicating the scores of the various members in the tournament; and providing a synchronizing link to connect the GW.OSs in a tournament with their respective Egs.

In several embodiments a GW.OS server can communicate with a patron management server. A GW.OS server can communicate with a patron management server to communicate any type of information as appropriate for a specific application, including (but not limited to) information for configuring tournaments according to system programming conducted by an operator of a multi-mode multi-jurisdiction skill wagering interleaved game, information for exchange of data used to link a player's player profile to their ability to participate in various forms of multi-mode multi-jurisdiction skill wagering interleaved game gameplay (such as, but not limited to, the difficulty of play set by the GW.OS server or the GW.OS), information for determining a player's ability to participate in a tournament as a function of a player's characteristics (such as, but not limited to, a player's gaming prowess or other metrics used for tournament screening), information for configuring GW.OS and Eg performance to suit preferences of a player on a particular multi-mode multi-jurisdiction skill wagering interleaved game, information for determining a player's play and gambling performance for the purposes of marketing intelligence, and information for logging secondary drawing awards, tournament prizes, RWC, and GWC into the player profile.

In many embodiments, the actual location of where various process are executed can be located either in the game-contained devices (RC.OS, GW.OS, Eg), on the servers (RC.OS server, GW.OS server, or Eg server), or a combination of both game-contained devices and servers. In particular embodiments, certain functions of a RC.OS server, GW.OS server, patron management server or Eg server can operate on the local RC.OS, GW.OS, or Eg contained with a multi-mode multi-jurisdiction skill wagering interleaved game locally. In certain embodiments, a server can be part of a server system including a plurality of servers, where software can be run on one or more physical devices. Similarly, in particular embodiments, multiple servers can be combined on a single physical device.

Figure 6A:
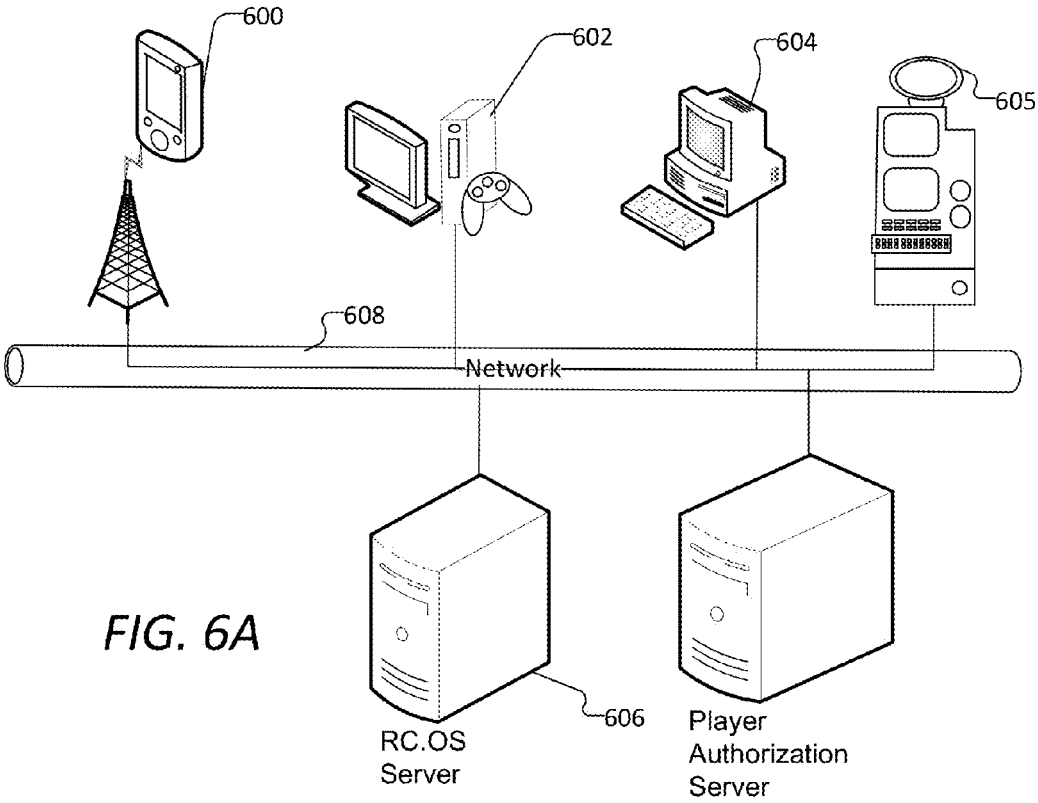
FIGS. 6A, 6B and 6C illustrate embodiments of a distributed multi-mode multi-jurisdiction skill wagering interleaved game in accordance with embodiments of the invention.

Some multi-mode multi-jurisdiction skill wagering interleaved games in accordance with many embodiments of the invention can be networked with remote servers in various configurations. Networked multi-mode multi-jurisdiction skill wagering interleaved game in accordance with embodiments of the invention are illustrated in FIGS. 6A. As illustrated, one or more end devices of networked multi-mode multi-jurisdiction skill wagering interleaved games, such as a mobile device 600, a gaming console 602, a personal computer 604, and an electronic gaming machine 605, are connected with a RC.OS server 606 over a network, such as a LAN or a WAN, 608. In these embodiments, the processes of an Eg and a GW.OS as described herein are executed on the individual end devices 600, 602, 604, and 605, while the processes of the RC.OS as described herein are executed by the RC.OS server 606.

Figure 6B:
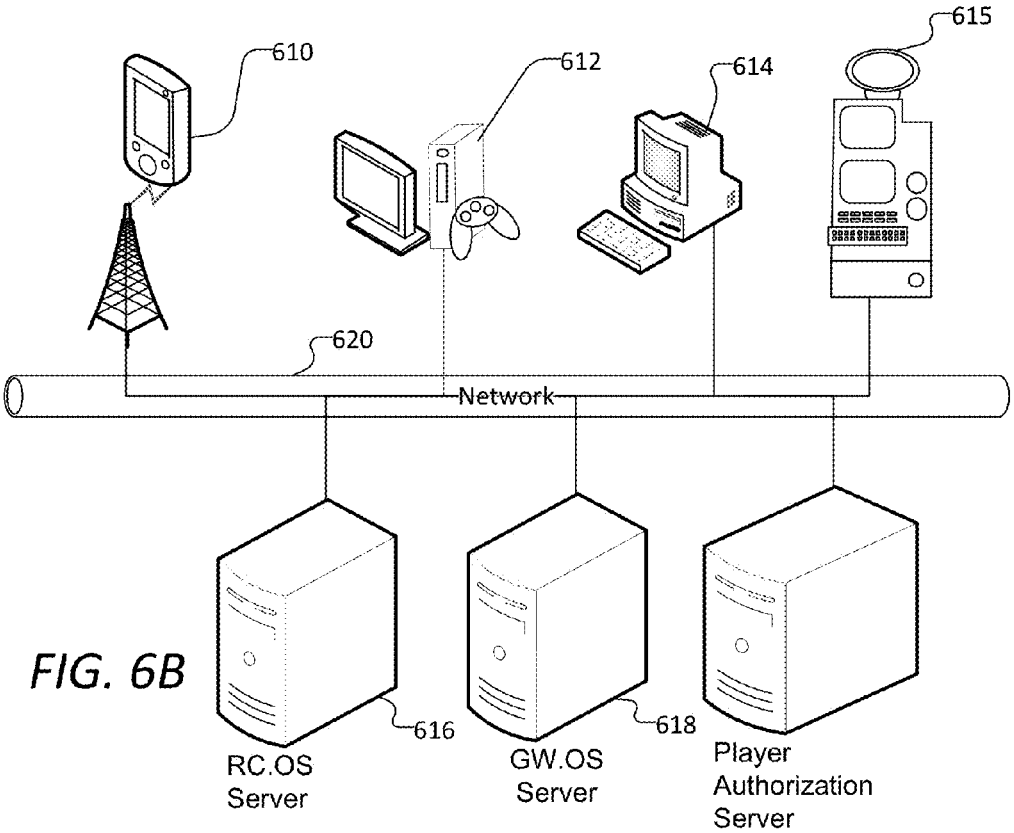

Other networked multi-mode multi-jurisdiction skill wagering interleaved games in accordance with embodiments of the invention are illustrated in FIG. 6B. As illustrated, one or more end devices of networked multi-mode multi-jurisdiction skill wagering interleaved games, such as a mobile device 610, a gaming console 612, a personal computer 614, and an electronic gaming machine 615, are connected with an RC.OS server 616 and a GW.OS server 618 over a network, such as a LAN or a WAN, 620. In these embodiments, the processes of an Eg as described herein are executed on the individual end devices 610, 612, 614, and 615, while the processes of the RC.OS as described herein are executed by the RC.OS server and the process of the GW.OS as described herein are executed by the GW.OS server.

Figure 6C:
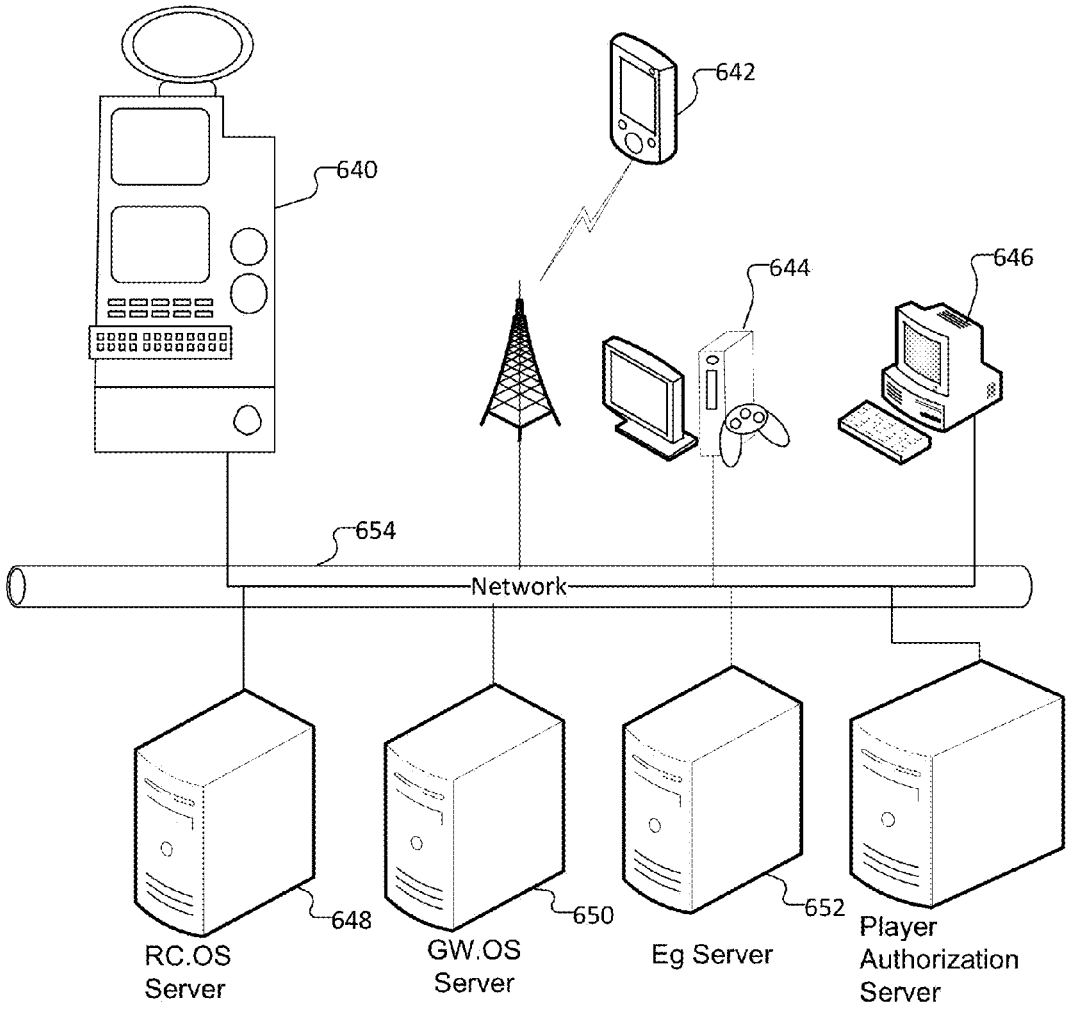

Additional networked multi-mode multi-jurisdiction skill wagering interleaved games in accordance with embodiments of the invention are illustrated in FIG. 6C. As illustrated, one or more end devices of networked multi-mode multi-jurisdiction skill wagering interleaved games, such as a mobile device 642, a gaming console 644, a personal computer 646, and an electronic gaming machine 640, are connected with an RC.OS server 648 and a GW.OS server 650, and an Eg server 652 over a network, such as a LAN or a WAN, 654. In these embodiments, the processes of a display and player interface of an Eg as described herein are executed on the individual end devices 640, 642, 644, and 646, while the processes of the RC.OS as described herein are executed by the RC.OS server, the processes of the GW.OS as described herein are executed by the GW.OS server, and the processes of an Eg excluding the display and player interfaces are executed on the Eg server 652.

In addition, a player authorization server 656 may be coupled to components of a multi-mode multi-jurisdiction skill wagering interleaved game via the network. The player authorization server 656 may facilitate determining a jurisdiction in which the player's device 642 is located based on location information from the player's device 642. The player authorization server 656 may further authorize or deny authorization for a player to engage in real currency wagering using the player's device 642.

In various embodiments, a patron management server may be operatively connected to components of a multi-mode multi-jurisdiction skill wagering interleaved game via the network 654. In other embodiments, a number of other peripheral systems, such as player management, casino management, regulatory, and hosting servers can also interface with the multi-mode multi-jurisdiction skill wagering interleaved games over a network within an operator's firewall. Also, other servers can reside outside the bounds of a network within an operator's firewall to provide additional services for network connected multi-mode multi-jurisdiction skill wagering interleaved games.

In numerous embodiments, a network distributed multi-mode multi-jurisdiction skill wagering interleaved game can be implemented on multiple different types of devices connected together over a network. Any type of device can be utilized in implementing a network distributed multi-mode multi-jurisdiction skill wagering interleaved game, such as, but not limited to, a gaming cabinet as used in a traditional land-based casino or a mobile computing device (such as, but not limited to, a PDA, smartphone, tablet computer, or laptop computer), a game console (such as, but not limited to, a Sony PlayStation®, or Microsoft Xbox®) or on a Personal Computer (PC). Each of the devices may be operatively connected to other devices or other systems of devices via a network for the playing of head-to-head games.

Although various networked multi-mode multi-jurisdiction skill wagering interleaved games are discussed above, multi-mode multi-jurisdiction skill wagering interleaved games can be networked in any configuration as appropriate to the specification of a specific application in accordance with embodiments of the invention. In certain embodiments, components of a networked multi-mode multi-jurisdiction skill wagering interleaved game, such as a GW.OS, RC.OS, Eg, or servers that perform services for a GW.OS, RC.OS, or Eg, can be networked in different configurations for a specific networked multi-mode multi-jurisdiction skill wagering interleaved game gameplay application. Processing apparatuses that can be implemented in a multi-mode multi-jurisdiction skill wagering interleaved game are discussed below.

Processing Apparatuses

Figure 7:
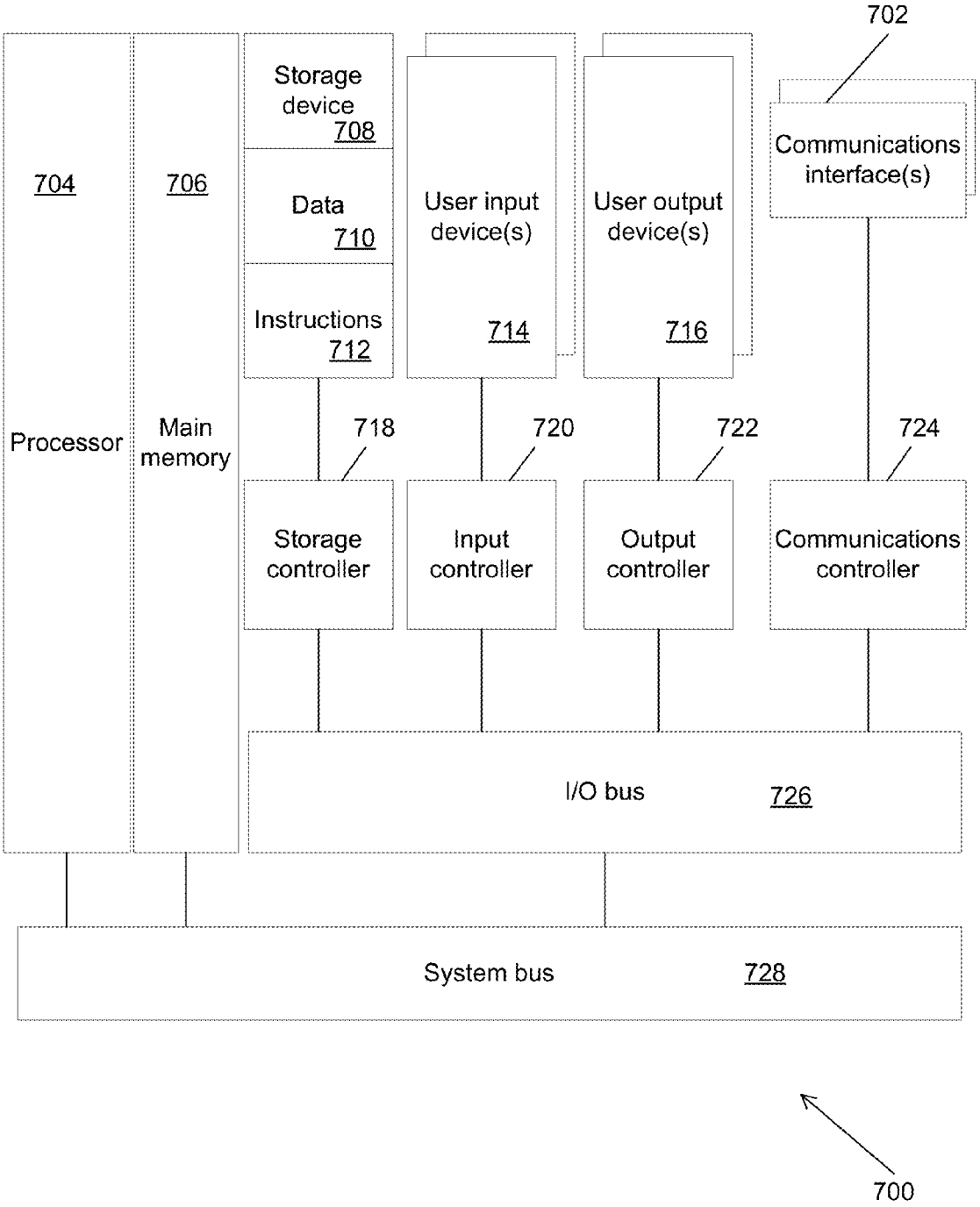
FIG. 7 is an illustration of a processing apparatus in accordance with various embodiments of the invention.

Any of a variety of processing apparatuses can host various components of a multi-mode multi-jurisdiction skill wagering interleaved game in accordance with embodiments of the invention. In several embodiments, these processing apparatuses can include, but are not limited to, a mobile device such as a tablet computer or a smartphone, an electronic gaming machine, a general purpose computer, a computing device, and/or a controller. A processing apparatus that is constructed to implement all or part of a multi-mode multi-jurisdiction skill wagering interleaved game in accordance with an embodiment of the invention is illustrated in FIG. 7.

In the processing apparatus 700, a processor 704 is coupled to a memory 706 by a system bus 728. The processor 704 is also coupled to non-transitory processor-readable storage medium, such as a storage device 708 that stores processor-executable instructions 712 and data 710 through the system bus 728 to an I/O bus 726 through a storage controller 718. The processor 704 is also coupled to one or more interfaces that can be used to connect the processor to other processing apparatuses as well as networks as described herein. The processor 704 is also coupled via the bus to user input devices 714, such as tactile devices including but not limited to keyboards, keypads, foot pads, touch screens, and/or trackballs, as well as non-contact devices such as audio input devices, motion sensors, and motion capture devices that the processing apparatus can use to receive inputs from a user when the user interacts with the processing apparatus. The processor 704 is connected to these user input devices 714 through the system bus 728, to the I/O bus 726, and through the input controller 720. The processor 704 is also coupled via the system bus 728 to user output devices 716 such as, but not limited to, visual output devices, audio output devices, and/or tactile output devices, that the processing apparatus 700 uses to generate outputs perceivable by the user when the user interacts with the processing apparatus. In several embodiments, the processor 704 is coupled to visual output devices such as, but not limited to, display screens, light panels, and/or lighted displays. In a number of embodiments, the processor 704 is coupled to audio output devices such as, but not limited to, speakers, and/or sound amplifiers. In many embodiments, the processor 704 is coupled to tactile output devices like vibrators, and/or manipulators. The processor 704 is connected to output devices from the system bus 728 to the I/O bus 726 and through the output controller 722. The processor 704 can also be connected to a communications interface 702 from the system bus 728 to the I/O bus 726 through a communications controller 724.

In various embodiments, the processor 704 can load instructions and data from the storage device into the memory. The processor 704 can also execute instructions that operate on the data to implement various aspects and features of the components of a multi-mode multi-jurisdiction skill wagering interleaved game as described herein. The processor 704 can utilize various input and output devices in accordance with the instructions and the data in order to create and operate player interfaces for players or operators of a multi-mode multi-jurisdiction skill wagering interleaved game (such as, but not limited to, a casino that hosts the multi-mode multi-jurisdiction skill wagering interleaved game).

Although the processing apparatus 700 is described herein as being constructed from a processor 704 and instructions stored and executed by hardware components, the processing apparatus 700 can be composed of only hardware components, or any combination thereof, in accordance with many embodiments. In addition, although the storage device is described as being coupled to the processor through a bus, those skilled in the art of processing apparatuses will understand that the storage device can include removable media such as but not limited to a USB memory device, an optical CD ROM, and magnetic media such as tape and disks. Also, the storage device can be accessed through one of the interfaces or over a network. Furthermore, any of the user input devices 714 or user output devices 716 can be coupled to the processor via one of the interfaces or over a network. In addition, although a single processor is described, those skilled in the art will understand that the processor 704 can be a controller or other computing device or a separate computer as well as be composed of multiple processors or computing devices.

In numerous embodiments, any of an RC.OS, GW.OS, or Eg as described herein can be implemented on multiple processing apparatuses, whether dedicated, shared or distributed in any combination thereof, or can be implemented on a single processing apparatus. In addition, while certain aspects and features of multi-mode multi-jurisdiction skill wagering interleaved game processes described herein have been attributed to an RC.OS, GW.OS, or Eg, these aspects and features can be implemented in a distributed form where any of the features or aspects can be performed by any of a RC.OS, GW.OS, Eg within a multi-mode multi-jurisdiction skill wagering interleaved game without deviating from the spirit of the invention.

Multi-Mode Multi-Jurisdiction Skill Wagering Interleaved Game Implementations

In several embodiments, a player can interact with a multi-mode multi-jurisdiction skill wagering interleaved game by using RWC in interactions with a gambling game along with GWC and elements in interactions with a multi-mode multi-jurisdiction skill wagering interleaved game entertainment game. The gambling game can be executed by a RC.OS, while a multi-mode multi-jurisdiction skill wagering interleaved game entertainment game can be executed with an Eg and managed with a GW.OS.

Figure 8:
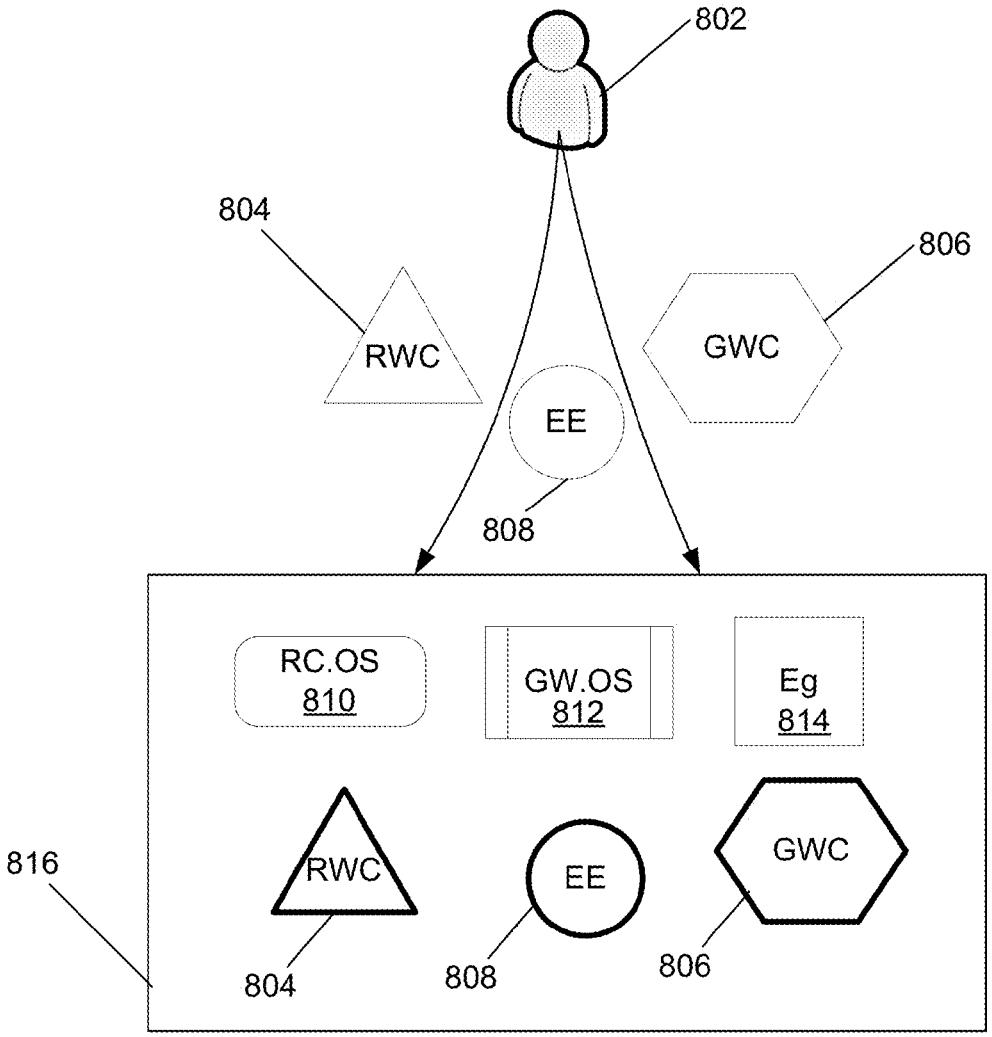
FIG. 8 is a process flow diagram that illustrates how resources are utilized in a multi-mode multi-jurisdiction skill wagering interleaved game in accordance with embodiments of the invention.

A conceptual diagram that illustrates how resources such as GWC, RWC, and elements, such as but not limited to EE, are utilized in a multi-mode multi-jurisdiction skill wagering interleaved game in accordance with an embodiment of the invention is illustrated in FIG. 8. The conceptual diagram illustrates that RWC 804, EE 808, and GWC 806 can be utilized by a player 802 in interactions with the RC.OS 810, GW.OS 812, and Eg 814 of a multi-mode multi-jurisdiction skill wagering interleaved game 816. The contribution of elements, such as EE 808, can be linked to a player's access to credits, such as RWC 804 or GWC 806. Electronic receipt of these credits can come via a smart card, voucher or other portable media, or as received over a network from a server. In certain implementations, these credits can be drawn on demand from a player profile located in a database locally on a multi-mode multi-jurisdiction skill wagering interleaved game or in a remote server.

Figure 9:
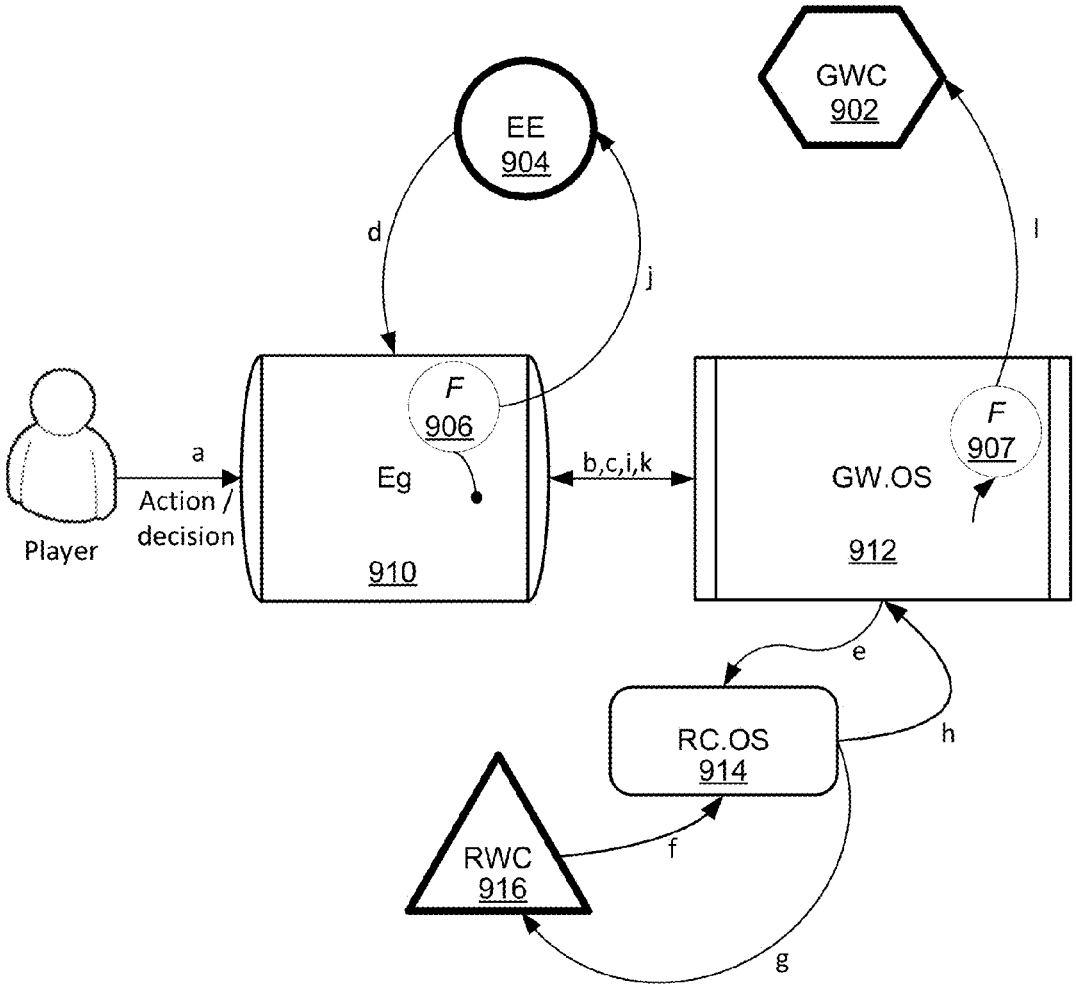
FIG. 9 is a process flow diagram that illustrates interplay between resources and components of a multi-mode multi-jurisdiction skill wagering interleaved game in accordance with embodiments of the invention.

A conceptual diagram that illustrates interplay between elements and components of a multi-mode multi-jurisdiction skill wagering interleaved game in accordance with an embodiment of the invention is illustrated in FIG. 9. Similar to FIG. 8, a player's actions and/or decisions can affect functions 906 that consume and/or accumulate GWC 902 and/or EE 904 in a multi-mode multi-jurisdiction skill wagering interleaved game entertainment game executed by an Eg 910, a RC.OS 914, and a GW.OS 912. The GW.OS 912 can monitor the activities taking place within a multi-mode multi-jurisdiction skill wagering interleaved game entertainment game executed by an Eg 910 for gameplay gambling event occurrences. The GW.OS 912 can also communicate the gameplay gambling event occurrences to the RC.OS 914 that triggers a wager of RWC 916 in a gambling game executed by the RC.OS 914.

In the figure, the player commences interaction with the multi-mode multi-jurisdiction skill wagering interleaved game by contributing one or more of three types of credits to the multi-mode multi-jurisdiction skill wagering interleaved game, the three being: (i) RWC 916, which is a currency fungible instrument, (ii) GWC 902, which are game world credits, and (iii) EE 904, which is the enabling element (EE) of the entertainment portion of the multi-mode multi-jurisdiction skill wagering interleaved game executed by the Eg 910. In many embodiments, an EE 904 is an element consumed by, traded or exchange in, operated upon, or used to enable the entertainment game portion of the multi-mode multi-jurisdiction skill wagering interleaved game. There may be one or more types of EE 904 present in a multi-mode multi-jurisdiction skill wagering interleaved game's entertainment game. Embodiments of EE 904 include, but are not limited to, bullets in a shooting game, fuel in a racing game, letters in a word spelling game, downs in a football game, potions in a character adventure game, character health points, etc.

The contribution of one or more of these elements may be executed by insertion into the multi-mode multi-jurisdiction skill wagering interleaved game of currency in the case of RWC 916, and/or transferred in as electronic credit in the case of any of the RWC 916, GWC 902, and EE 904. Electronic transfer in of these credits may come via a smart card, voucher, or other portable media, or as transferred in over a network from a patron server or multi-mode multi-jurisdiction skill wagering interleaved game player account server. In certain implementations, these credits may not be transferred into the multi-mode multi-jurisdiction skill wagering interleaved game, but rather drawn on demand from player accounts located in servers residing on the network or in the cloud on a real time basis as the credits are consumed by the multi-mode multi-jurisdiction skill wagering interleaved game. Once these credits are deposited, or a link to their availability is made, the multi-mode multi-jurisdiction skill wagering interleaved game has them at its disposal to use for execution of the multi-mode multi-jurisdiction skill wagering interleaved game. Generally, the RWC 916 is utilized by and accounted for by the RC.OS 914, and the EE 904 and GWC 902 are utilized and accounted for by the GW.OS 912 and/or the Eg 910.

An operation of the multi-mode multi-jurisdiction skill wagering interleaved game is illustrated by the following table:

a The player performs an action or makes a decision through the multi-mode multi-jurisdiction skill wagering interleaved game UI b The Eg 910 signals the GW.OS 912 of the player decision or action taken c The GW.OS 912 signals to the Eg 910 as to the amount of EE 904 that will be consumed by the player action or decision. This signaling configures function 906 to control the EE 904 consumption, decay, or addition d The Eg 910 consumes the amount of EE 904 designated by the GW.OS 912 to couple to the player action e The GW.OS 912 signals to the RC.OS 914 as to the profile of the wager proposition associated with the particular action, and triggers the wager f The RC.OS 914 consumes RWC 916 for the wager and executes the wager -continued

| | |
|---|---|
| g | The RC.OS 914 returns RWC depending on the outcome of the wager |
| h | The RC.OS 914 informs the GW.OS 912 as to the outcome of the wager |
| i | The GW.OS 912 signals to the Eg 910 to add additional (or subtract, or add 0) EE 904 to one or more of the EEs of the Eg 910. This is reflected as function 906 in the figure. |
| j | The Eg 910 reconciles the EE(s) of the entertainment game |
| k | The Eg 910 signals the GW.OS 912 as to its updated status, and the GW.OS 912 signals the Eg 910 to add additional (or subtract, or add 0) GWC 902 to one or more of the GWC 902 of the Eg 910. This is reflected in function 907 in the figure |
| l | The GW.OS 912 reconciles the GWC(s) of the entertainment game |

The credit flow according to the process described above can be illustrated by the following embodiment in a first person shooter game, such as Call of Duty®, again using the same multi-mode multi-jurisdiction skill wagering interleaved game process:

| | |
|---|---|
| A | The player selects a machine gun to use in the multi-mode multi-jurisdiction skill wagering interleaved game. The player fires a burst at an opponent. {The player performs an action or makes a decision through the multi-mode multi-jurisdiction skill wagering interleaved game UI} |
| B | The Eg signals the GW.OS of the player's choice of weapon, that a burst of fire was fired, and the outcome of whether the player hit the opponent with the burst of fire. {The Eg 910 signals the GW.OS 912 of the player decision or action taken} |
| C | The GW.OS processes the information in b above, and signals the Eg to consume 3 bullets (EE) with each pull of the trigger. {The GW.OS 912 signals to the Eg 910 as to the amount of EE 904 that will be consumed by the player action or decision. This signaling configures function 906 to control the EE 904 consumption, decay, or addition} |
| D | The Eg entertainment game consumes 3 bullets (EE) since the trigger was pulled. {The Eg 910 consumes the amount of EE 904 designated by the GW.OS 912 to couple to the player action} |
| E | The GW.OS signals the RC.OS that 3 credits (RWC) are to be wagered to match the 3 bullets (EE) consumed, on a particular pay table (Table Ln-RC) as a function how much damage the player inflicted on his/her opponent. {The GW.OS 912 signals to the RC.OS 914 as to the profile of the wager proposition associated with the particular action, and triggers the wager} |
| F | The RC.OS consumes the 3 credits for the wager and executes the specified wager {The RC. OS 914 consumes RWC 916 for the wager and executes the wager} |
| G | The RC.OS determines that the player hits a jackpot of 6 credits, and returns these 6 credits (RWC) to the credit meter. {The RC.OS 914 returns RWC depending on the outcome of the wager} |
| H | The RC.OS informs the GW.OS that 3 credits (RWC) net, were won {The RC.OS 914 informs the GW.OS 912 as to the outcome of the wager} |
| I | The GW.OS signals the Eg to add 3 bullets (EE) to the player's ammo clip {The GW.OS 912 signals to the Eg 910 to add additional (or subtract, or add 0) EE 904 to one or more of the EEs of the Eg 910. This is reflected as function 906 in the figure} |
| J | The Eg adds back 3 bullets (EE) to the player's ammo clip in the entertainment game. This may take place by directly adding them to the clip, or may happen in the context of the entertainment game, such as the player finding extra ammo on the ground, or in an old abandoned ammo dump. {The Eg 910 reconciles the EE(s) of the entertainment game} |
| K | The GW.OS logs the new player score (GWC) in the multi-mode multi-jurisdiction skill wagering interleaved game (as a function of the successful hit on the opponent) based on Eg signaling, and signals the Eg to add 2 extra points to their score, because a jackpot was won. {The Eg 910 signals the GW.OS 912 as to its updated status, and the GW.OS 912 signals the Eg 910 to add additional (or subtract, or add 0) GWC 902 to one or more of the GWC 902 of the Eg 910. This is reflected in function 907 in the figure} |
| L | The GW.OS adds 10 points to the player's score (GWC) given the success of the hit, which in this embodiment is worth 8 points, plus the 2 extra points requested by GW.OS. {The GW.OS 912 reconciles the GWC(s) of the entertainment game} |

Note that the foregoing embodiments are intended to provide an illustration of how credits flow in a multi-mode multi-jurisdiction skill wagering interleaved game, but are not intended to be exhaustive, and only list only one of numerous possibilities of how a multi-mode multi-jurisdiction skill wagering interleaved game may be configured to manage its fundamental credits.

The multi-mode multi-jurisdiction skill wagering interleaved game system of FIG. 9 may also utilize virtual currency instead of RWC. Virtual currency can be thought of as a form of alternate currency, which can be acquired, purchased or transferred, in unit or in bulk, by/to a player, but does not necessarily directly correlate to RWC or real currency. In a particular embodiment, there is a virtual currency called "Triax Jacks," 1000 units of which are given to a player by an operator of a multi-mode multi-jurisdiction skill wagering interleaved game, with additional blocks of 1000 units being available for purchase for $5 USD for each block. Triax Jacks could be redeemed for various prizes, or could never be redeemed but simply used and traded purely for entertainment value by players. It would be completely consistent with the architecture of the multi-mode multi-jurisdiction skill wagering interleaved game that Triax Jacks would be wagered in place of RWC, such that the multi-mode multi-jurisdiction skill wagering interleaved game could be played for free, or with played with operator sponsored Triax Jacks.

Figure 10:
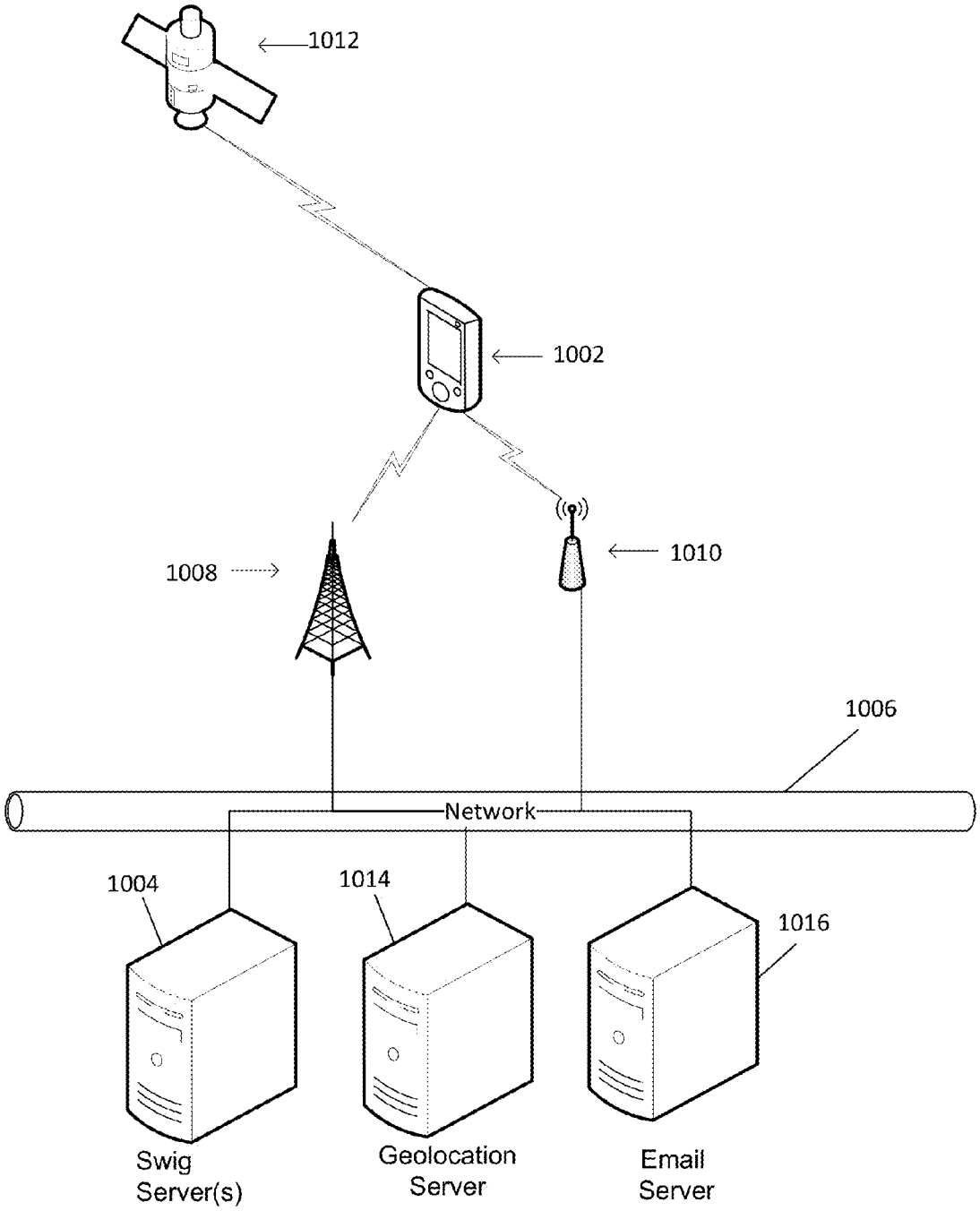
FIG. 10 illustrates a system for a multi-mode multi-jurisdiction skill wagering interleaved gam in accordance with embodiments of the invention.

FIG. 10 illustrates a system for a multi-mode multi-jurisdiction skill wagering interleaved game in accordance with embodiments of the invention. In such a system, a mobile device 1002, acting as a device on which an Eg is executed, is operatively connected to one or more SWig servers 1004 through a network 1006. The mobile device 1002 may be connected through one or more possible systems. For example, the mobile device 1002 may be connected to the network 1006 over a mobile telephone network 1008 using a mobile telephone communications protocol. The mobile device 1002 may also be connected to the network via an access point 1010 using a networking protocol. In addition, the mobile device may have a global positioning system (GPS) sensor and related processor and may receive signals form a GPS satellite 1012 for determining positioning information.

The one or more SWig servers 1004 may be further connected through the network 1006 to a geographical location server 1014. The geographical location server 1014 stores geographical information associated with mobile telephone towers, network access points, and any other types of communication or network access points that may be tied to a geographical location. The one or more SWig servers 1004 may also be connected via the network 1006 to an email server 1016 or a text message server.

Figure 11:
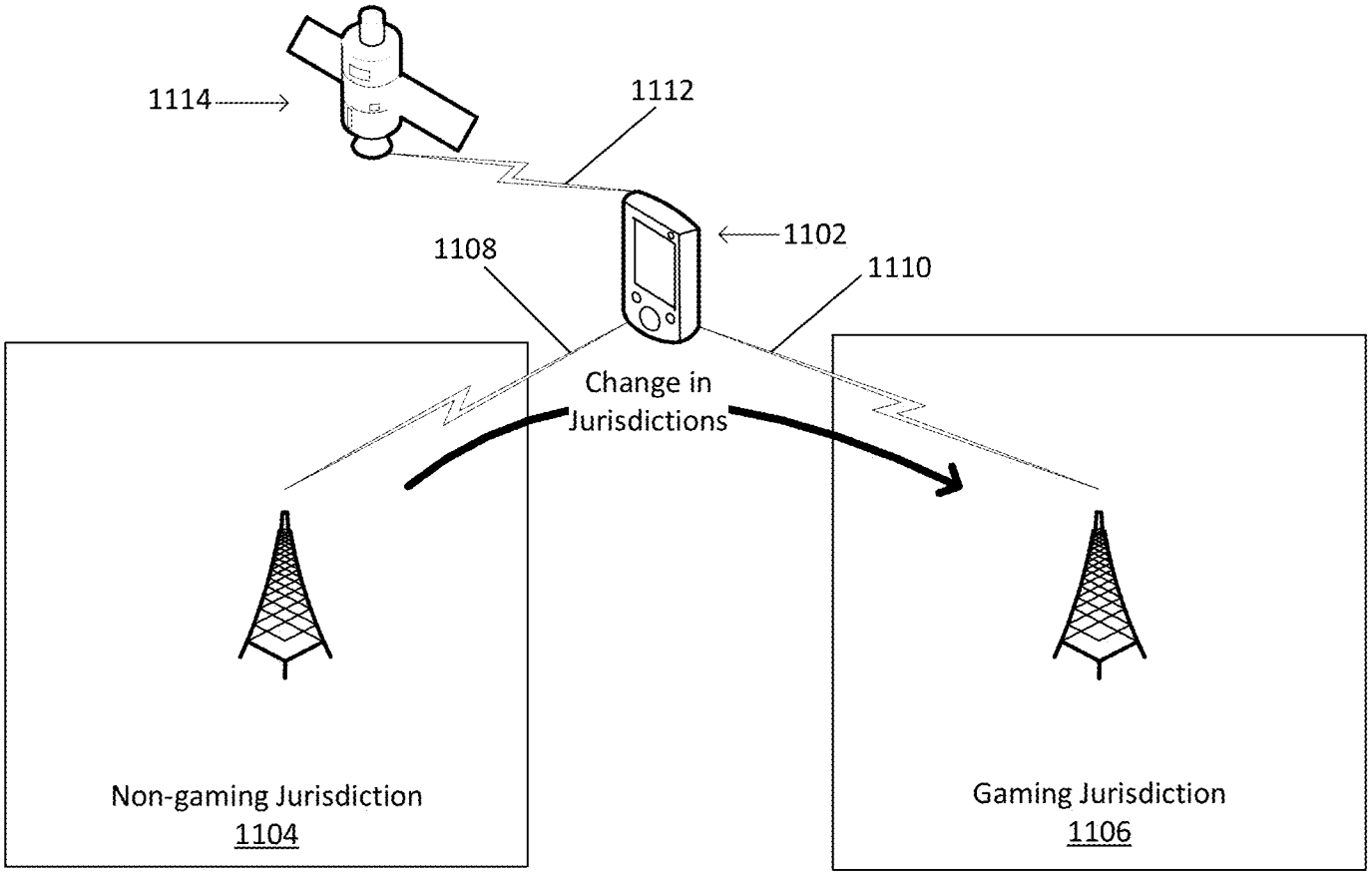
FIG. 11 illustrates movement of a player's device of a system for a multi-mode multi-jurisdiction skill wagering interleaved game between gaming jurisdictions in accordance with embodiments of the invention.

FIG. 11 illustrates movement of a player's device, in a system for a multi-mode multi-jurisdiction skill wagering interleaved game, between gaming jurisdictions in accordance with embodiments of the invention. As illustrated, a player's device 1102 may move between jurisdictions that have different rules regarding gambling. As illustrated, the player's device 1002 may be moved by a player from a non-gaming jurisdiction 1004 to a gaming jurisdiction 1106. In doing so, the player's device 1002 may drop a connection 1108 to a network in communication with (e.g., within) the non-gaming jurisdiction 1104 and pick up another connection 1110 to a network in communication with (e.g., within) the gaming jurisdiction 1106 that allows gaming. In addition, the player's device 1102 may retain its connection 1112 to a GPS satellite 1114.

In operation, while the player's device 1102 is in (e.g., physically located within the geographic boundaries of) the non-gaming jurisdiction 1104, the multi-mode multi-jurisdiction skill wagering interleaved game restricts game play to those elements that do not include gambling. In one embodiment, the elements of the entertainment game portion of the multi-mode multi-jurisdiction skill wagering interleaved game that are used to initiate wagers in a gambling game are disabled such that no wagering or gambling occurs. In another embodiment, when the multi-mode multi-jurisdiction skill wagering interleaved game is in (e.g., physically located within the geographic boundaries of) the gaming jurisdiction 1106, a virtual currency is used in the wagering portions of the gambling game. When the player's device 1102 is moved into the gaming jurisdiction 1106, this change in location is detected and all of the gambling features of the multi-mode multi-jurisdiction skill wagering interleaved game as described herein are enabled.

Figure 12:
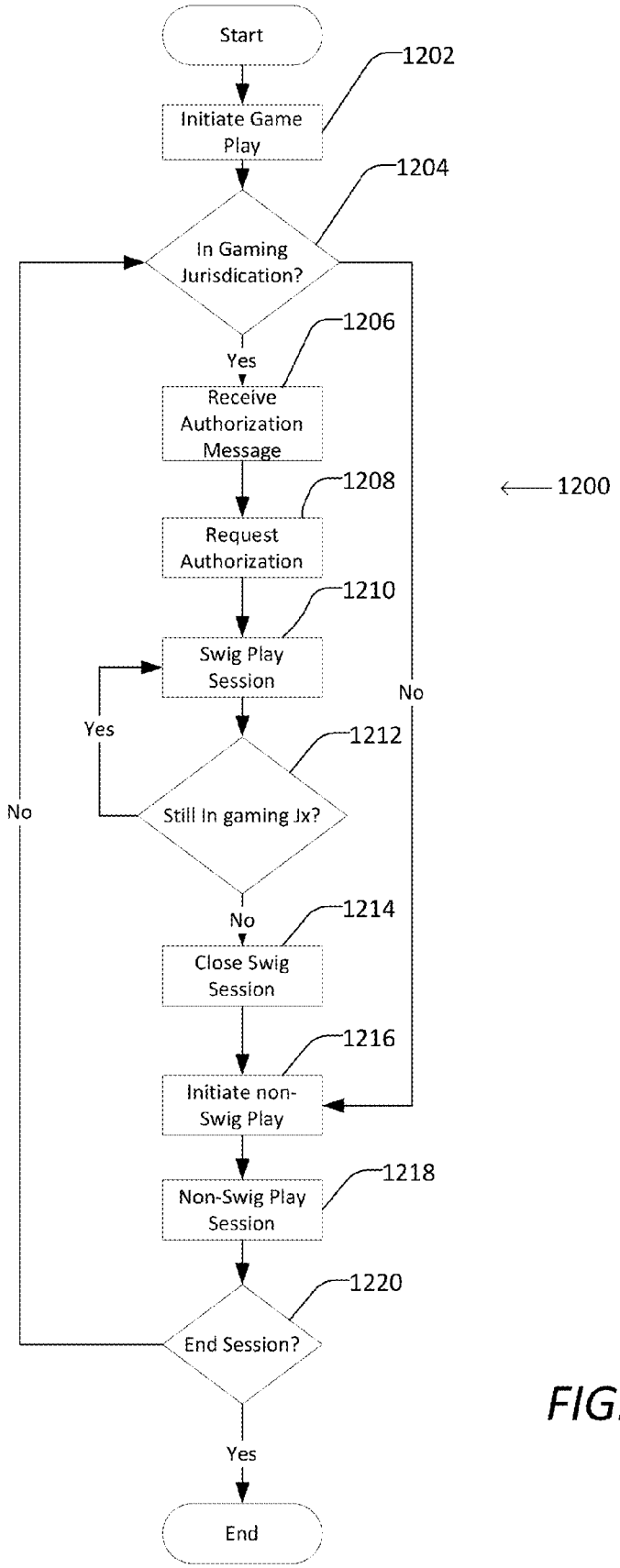
FIG. 12 illustrates an operational process in a system for a multi-mode multi-jurisdiction skill wagering interleaved game between gaming jurisdictions in accordance with embodiments of the invention.

FIG. 12 illustrates an operational process 1200 of a system for a multi-mode multi-jurisdiction skill wagering interleaved game between gaming jurisdictions in accordance with embodiments of the invention. As illustrated, the process 1200 starts, at operation 1202, when a player initiates game play using a multi-mode multi-jurisdiction skill wagering interleaved game. The multi-mode multi-jurisdiction skill wagering interleaved game determines, at operation 1204, if a player's device component of the multi-mode multi-jurisdiction skill wagering interleaved game that the player is using to play the multi-mode multi-jurisdiction skill wagering interleaved game is within a gaming jurisdiction that allows gaming. If not, at operation 1216, a non-SWig gaming session is initiated wherein the player plays the entertainment game portion of the multi-mode multi-jurisdiction skill wagering interleaved game without wagering enabled or wherein wagering is conducted using a virtual currency. If the player's device is in a jurisdiction that allows gaming, at operation 1206, the multi-mode multi-jurisdiction skill wagering interleaved game sends to the player a text message or an email message indicating that the player is permitted to gamble in the player's location and requests, at operation 1208, authorization from the player to gamble. If the player provides authorization, then the multi-mode multi-jurisdiction skill wagering interleaved game proceeds, at operation 1210, in a SWig session where the entertainment game portion of the multi-mode multi-jurisdiction skill wagering interleaved game is played and wagers are triggered as described herein. Periodically, the multi-mode multi-jurisdiction skill wagering interleaved game again determines, at operation 1212, if the player's device is still located in the gaming jurisdiction. If so, the SWig session continues, at operation 1210, with wagering enabled using real credits. If the player's device is no longer in a gaming jurisdiction, then, at operation 1214, the SWig is closed, ending wagering using real credits. A non-SWig session is then initiated, at operation 1216, and the player may continue, at operation 1218, to play the entertainment game portion of the multi-mode multi-jurisdiction skill wagering interleaved game wherein wagering is disabled, or wagering is performed using a virtual currency. The non-SWig gaming session is conducted until the player exits or ends the gaming session, at operation 1220.

Figure 13:
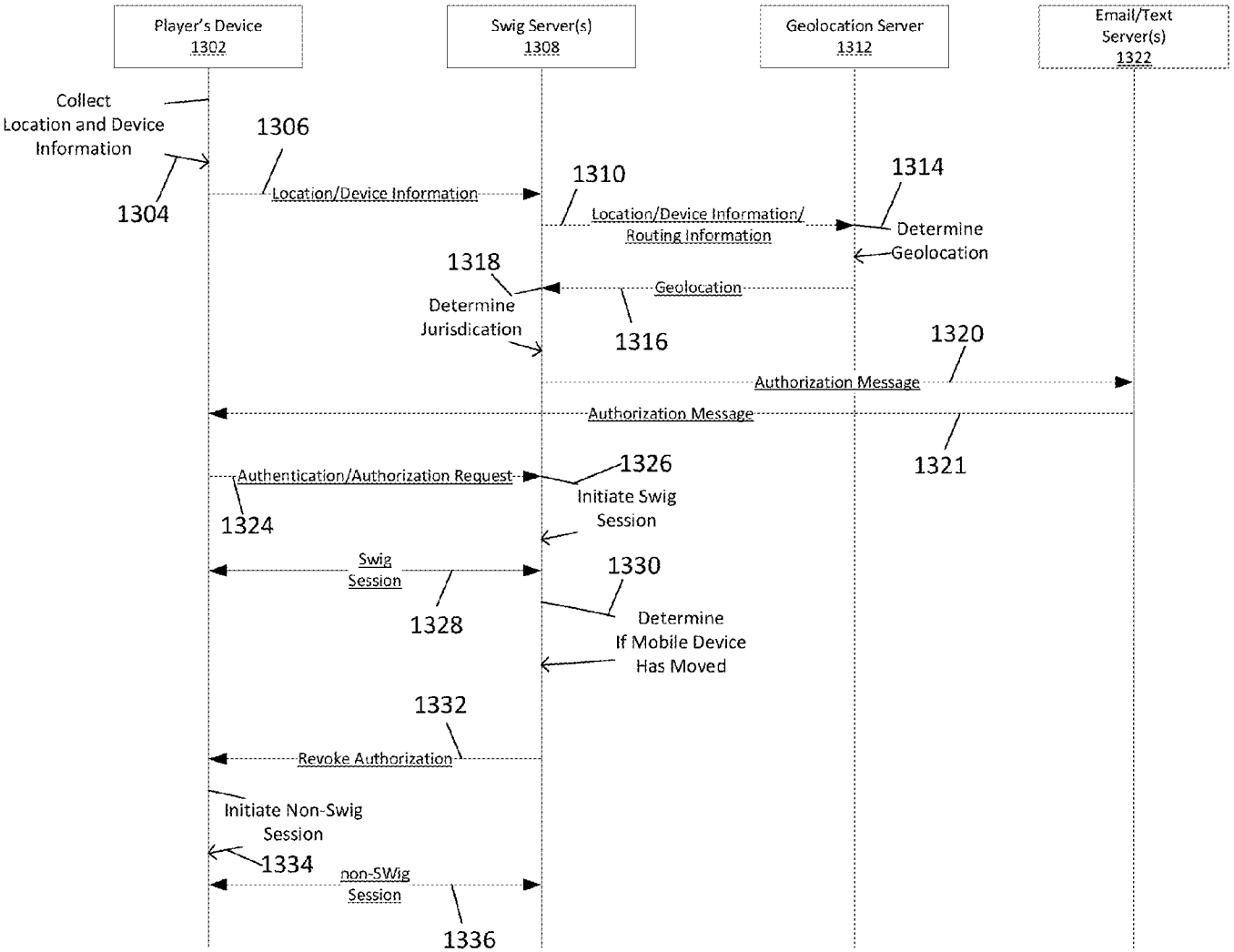
FIG. 13 illustrates a sequence of operations for a system for a multi-mode multi-jurisdiction skill wagering interleaved game between gaming jurisdictions in accordance with embodiments of the invention.

FIG. 13 illustrates a sequence of operations for a system for a multi-mode multi-jurisdiction skill wagering interleaved game between gaming jurisdictions in accordance with embodiments of the invention. A player's device 1302 that is part of a multi-mode multi-jurisdiction skill wagering interleaved game system collects information (1304) about the player's device 1302 to be used for geographical location. In some embodiments, the player's device may have access to GPS information. The player's device 1302 transmits (1306) the device information to a SWig server 1308, including the GPS information, if available. The SWig server 1308 receives the player's device information. In addition, the Swig server 1308 collects network information for the access point used by the player's device to access a network used by the player's device to connect to the one or more SWig servers 1308. The access point information and GPS data, if available, is forwarded (1310) to a geographical location server 1312. The geographical location server 1312 receives the device information and the access point information. The geographical location server 1312 determines (1314) a physical location of the access point used by the player's device 1302 using tabulated network addresses of the access points associated with geographic locations of the access points. In some embodiments, if the information sent by the one or more SWig servers 1308 includes GPS information collected by the player's device 1302, the GPS information may be correlated with the access point information to confirm the location of the player's device 1302.

The geographical location server 1312 transmits (1316) the geographical location of the player's device 1302 to the one or more SWig servers 1308. The one or more SWig servers 1308 determine (1318) if the geographical location of the player's device 1302 is within a gaming jurisdiction. If so, the one or more SWig servers 1308 send (1320, 1321) an authorization message, via an email or text server 1322, to the player's device. The authorization message provides a notification to the player that the player's device 1302 is now in a jurisdiction that allows gaming. In some embodiments, the notification also includes a link to an application on the player's device 1302 enabling the player to authorize gambling on the player's device 1302. The player uses the player's device 1302 to authorize gambling and the player's device transmits (1324) the authorization to the one or more SWig servers 1308. The one or more SWig servers 1308 initiate (1326) a SWig gaming session (1328) wherein wagering is conducted using real credits as described herein. During the SW Ig session (1328), the player's device continues to send player's device information to the one or more SWig servers 1308. In some embodiments, the player's device information includes GPS information. The one or more SWig servers 1308 use the device information to determine (1330) if the player's device has changed location. If so, the one or more SWig servers 1308 revoke authorization (1332) of real credit wagering. In some embodiments, the one or more SWig servers 1308 attempt reauthorization of the gambling aspects of the SWig session (1328). If the gambling authorization is revoked, the player's device initiates (1334) a non-SWig gaming session (1336) where wagering is either not enabled, or wagering is performed using a virtual currency.

In some embodiments, a player's device 1302 used by a player to access and play a SWig game is geo-fenced by wireless access points. In such an embodiment, the one or more SWig servers 1308 implementing the SWig in conjunction with the player's device 1302 are accessible through a set of wireless access points that define an enabling area that is controlled by a casino or other operator. Within the enabling area, as indicated by the player's device 1302 accessing the one or more SWig servers through the defined set of access points, gambling is enabled for the SWig as described herein, outside of that area, gambling with the SWig game is disabled. In such an embodiment, the one or more SWig servers 1308 may not need to access a geolocation server 1312 to determine whether or not a player's device 1302 is in the enabling area, because the identity of the access points is known.

In some embodiments, when the player's device 1302 loses connectivity with the one or more SWig servers 1308, the one or more SWig servers 1308 end the SWig gambling session. However, the player's device 1302 continues to allow the player to play the SWig game in a non-gambling mode.

Figure 14:
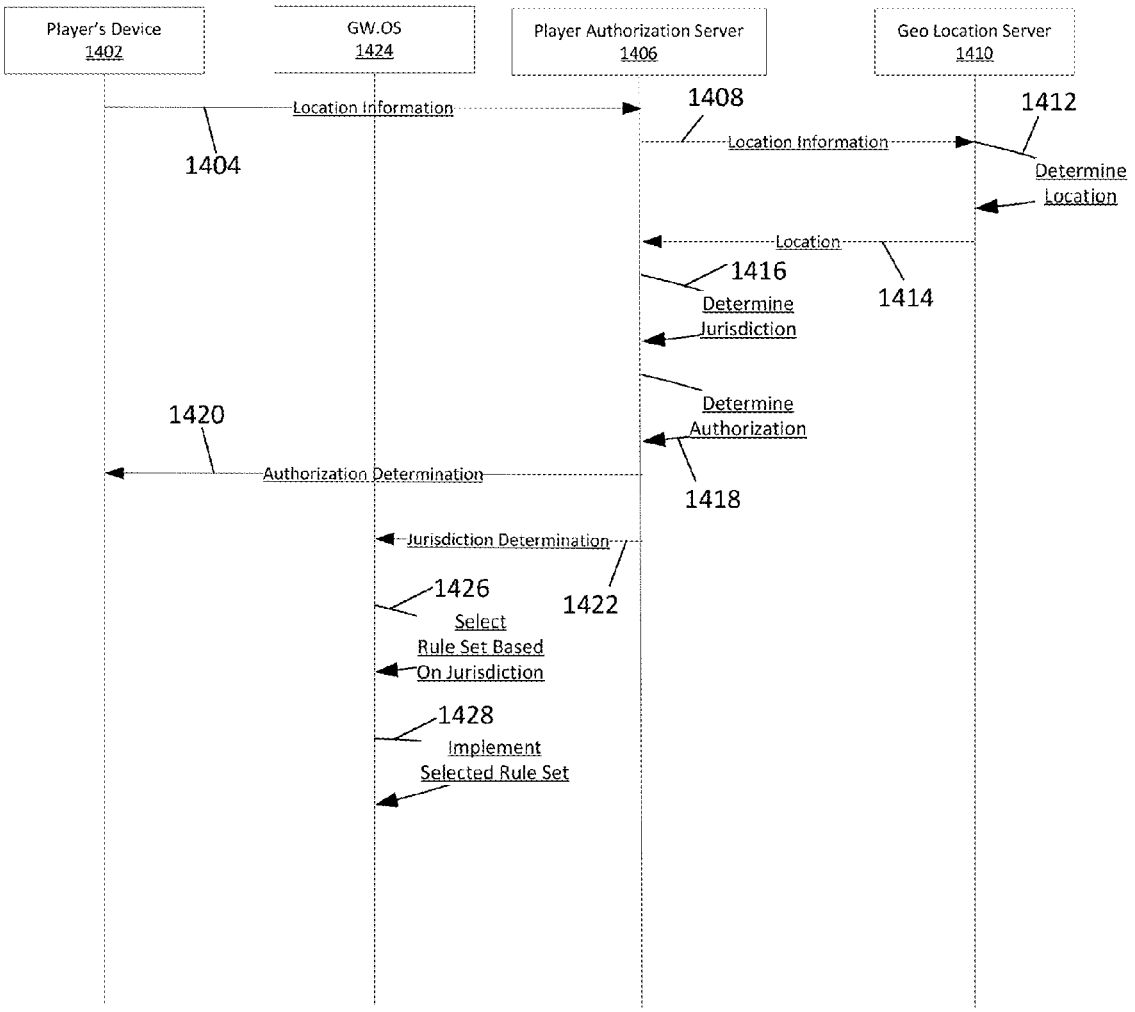
FIG. 14 illustrates a sequence of operations for a system for selecting a rule set for a multi-mode multi-jurisdiction skill wagering interleaved game between gaming jurisdictions in accordance with embodiments of the invention.

FIG. 14 illustrates a sequence of operations for a system for selecting a rule set for a multi-jurisdiction skill wagering interleaved game between gaming jurisdictions in accordance with embodiments of the invention. As illustrated, a player's device 1402 sends (1404) location information to a player authorization server 1406. The player authorization server 1406 forwards (1408) the location information to a geo location server 1410. The geo location server 1410 uses the location information to determine (1412) a location for the player's device 1402. The location is transmitted (1414) from the geo location server 1410 to the player authorization server 1406. The player authorization server 1406 determines (1416) the jurisdiction in which the player's device is located from the location information. The player authorization server 1406 also determines (1418) whether or not real money gaming is permitted in the jurisdiction where the player's device is located. If real money gaming is permitted, the player's device is granted authorization for real money gaming. If real money gaming is not allowed, the player's device is granted authorization only for gaming using virtual credits or for gaming as a pure entertainment game and not a SWig game with interleaved wagering. The authorization is transmitted (1420) from the player authorization server 1406 to the player's device 1402. The player's device 1402 receives the authorization and either executes a SWig game with real money wagering, a SWig game using virtual credits, or simply executes the entertainment game portion of the SWig game.

The player authorization server transmits (1422) the jurisdiction determination to the GW.OS 1424. The GW.OS 1424 receives the jurisdiction determination to select (1426) one or more rule sets (such as rules 129 as stored in rule set data store 127, both of FIG. 1) that are used for one or more rules engines of a game world decision engine (such as game world decision engine 122 of FIG. 1) of the GW.OS 1424 for determining wager decisions and/or game world resources (such as game world resources 136 and wager decisions 125, both of FIG. 1.) The selected rule set is then implemented (1428) by the GW.OS 1424 during subsequent operations of the GW.OS 1424 during a gaming session.

Figure 15A:
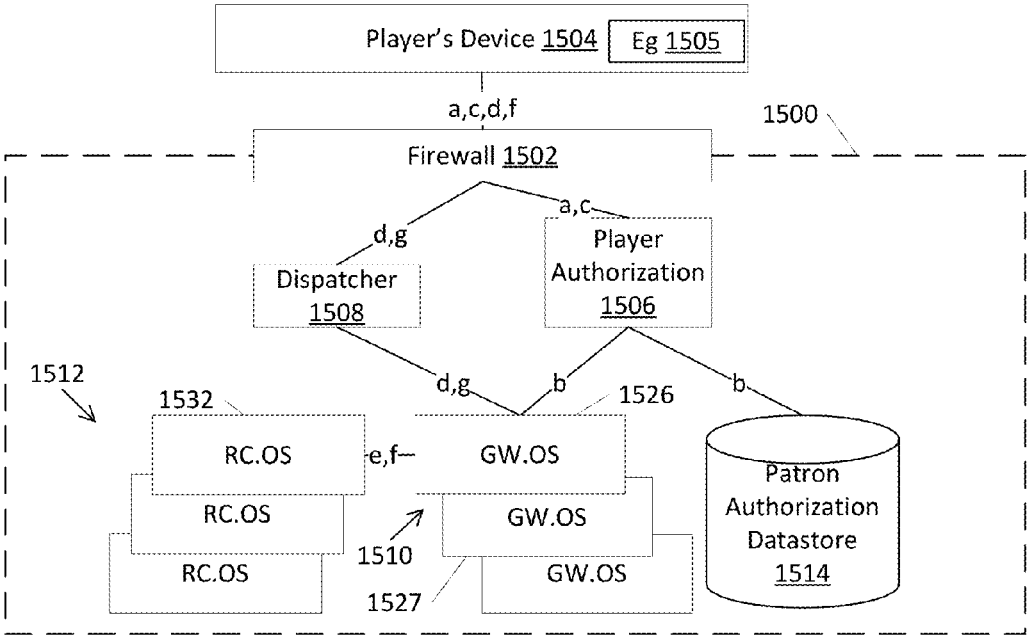
FIG. 15A is an architecture diagram of a system for implementing a multi-mode multi-jurisdiction skill wagering interleaved game having multiple instances of a game world operating system (GW.OS) in accordance with embodiments of the invention.
Figure 15B:
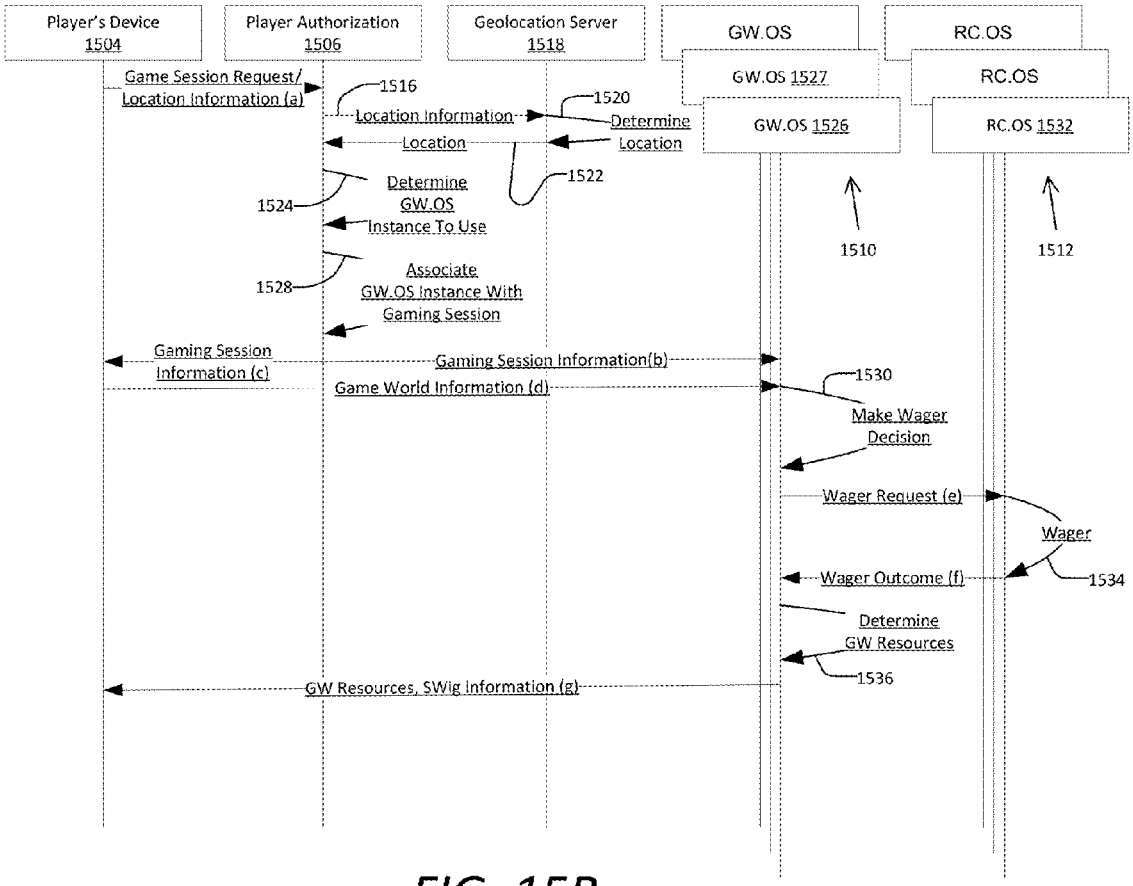
FIG. 15B is a sequence diagram for an operational process of a multi-mode multi-jurisdiction skill wagering interleaved game in accordance with embodiments of the invention.

FIG. 15A is an architecture diagram of a system for implementing a multi-mode multi-jurisdiction skill wagering interleaved game having multiple instances of a GW.OS in accordance with embodiments of the invention and FIG. 15B is a sequence diagram for an operational process of a multi-mode multi-jurisdiction skill wagering interleaved game in accordance with embodiments of the invention. Referring now to FIGS. 15A and 15B, a system 1500 implementing a multi-mode multi-jurisdiction skill wagering interleaved game couples to a player's device 1504 over a network (not shown) such as a LAN or a WAN. The player's device 1504 includes an instantiation of a SWig game 1505 that a player will play during a gaming session. A firewall 1502 admits communications from the player's device 1504 to a player authorization module 1506 and to a message dispatcher module 1508.

The system further includes a plurality of instances of GW.OSes 1510, which may run concurrently. In some embodiments, the plurality of GW.OSes 1510 are instantiated with configurations for different jurisdictions and/or different modes of play. For example, a GW.OS may be instantiated for a jurisdiction that does not allow real money gaming, in which case the GW.OS will operate using virtual currency. As another example, a GW.OS may be instantiated for a jurisdiction with real money gaming including using in-game purchases for game world objects by a player.

The system further includes a plurality of RC.OSes 1512, which may be running concurrently. In some embodiments, an RC.OS may be instantiated for real money gaming. In other embodiments, an RC.OS may be instantiated for virtual money gaming. In various embodiments, the GW.OSes 1510 and RC.OSes 1512 allow for any combination of real money gaming, virtual currency gaming, and in-game purchases to be conducted through appropriate configuration of a GW.OS and an RC.OS when they are instantiated by the system. The system also includes a patron authorization database 1514 used to store session information.

Referring to FIGS. 15A and 15B, in operation, the player's device 1504 transmits a request (a) for a gaming session to the player authorization module 1506. The gaming session request includes location information that may be transmitted (1516; FIG. 15B) by the player authorization module 1506 to a geo location server 1518, which uses the location information to determine (1520; FIG. 15B) the location of the player's device 1504. The location is transmitted (1522; FIG. 15B) from the geo location server 1518 to the player authorization module 1506.

The player authorization module 1506 determines (1524; FIG. 15B) which of the GW.OSes 1510 is appropriate for the player's device's location, and associates (1528; FIG. 15B) the GW.OS 1526 with the gaming session. For example, if the player's device 1504 is located where real money gaming is allowed, the player authorization module 1506 selects a GW.OS 1526 that enables real money gaming. However, if the player's device 1504 is located in a jurisdiction where real money gaming is not allowed, the player authorization module 1506 selects a GW.OS 1527 that enables virtual currency gaming and not real money gaming. The player authorization module 1506 transmits gaming session information (b) to the selected GW.OS 1526, thereby notifying the selected GW.OS 1526 that the selected GW.OS 1526 has been selected and bound to a gaming session. This information regarding the gaming session binding the selected GW.OS 1526 to the player's device 1504 is also stored in the patron authorization database 1514 for future reference. Information about the gaming session (c) is transmitted to the player's device 1504 by the player authorization module 1506.

During the gaming session, the player's device 1504 transmits game world information (d) to the selected GW.OS 1526 through the dispatcher 1508. The game world information includes session information that the dispatcher 1508 broadcasts to all GW.OSes 1510 within the system 1500 that have been instantiated and bound to a gaming session. If the broadcast gaming session information matches the game session information that GW.OS 1526 has indicating that GW.OS 1526 was bound to that particular gaming session, the GW.OS 1526 receives the game world information and determines (1530; FIG. 15B) a wagering decision as described herein. If a wager is to be made, the GW.OS 1526 transmits a wager request (e) to an RC.OS 1532. The RC.OS 1532 receives the wager request and makes the requested wager (1534; FIG. 15B). The RC.OS 1532 transmits the wager outcome (f) to the GW.OS 1526. The GW.OS 1526 receives the wager outcome and determines 1536 what game world resources should be allocated in the gaming session as a result of the wager outcome and game world information as described herein. The GW.OS 1526 transmits the game world resources and SWig information (g) as described herein to the player's device 1504.

In many embodiments, the dispatcher 1508, player authorization module 1506, RC.OSes 1512, GW.OSes 1510, and patron authorization datastore 1514 are all instantiated on the same hosting device and/or server. In some embodiments, the dispatcher 1508, player authorization module 1506, RC.OSes 1512, GW.OSes 1510, and patron authorization datastore 1514 may be instantiated on more than one hosting device and/or server.

Figure 16A:
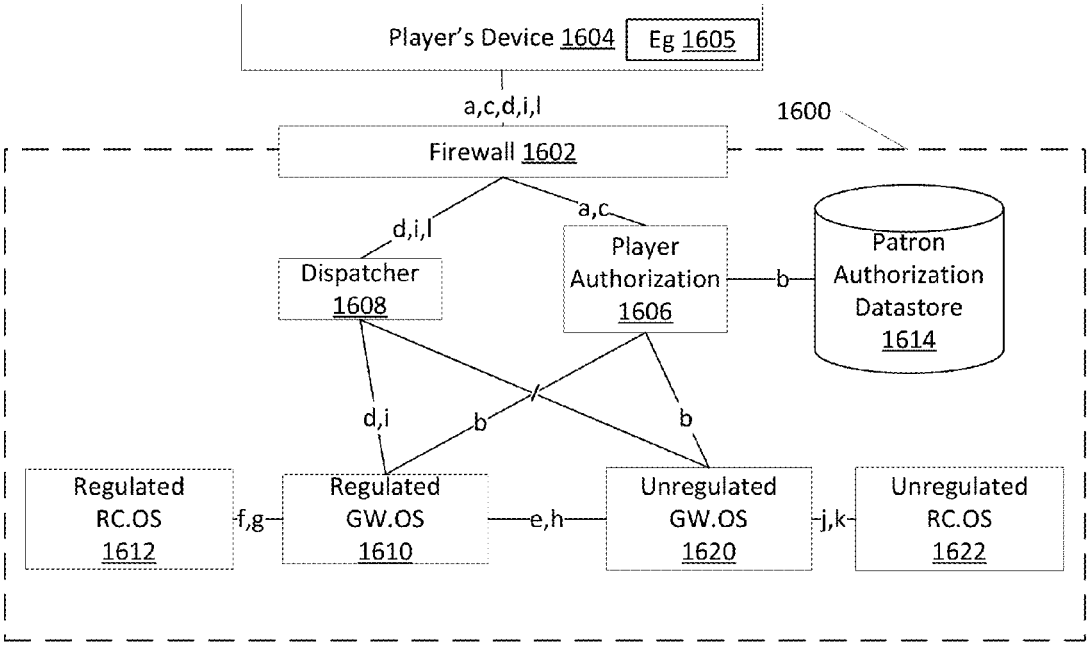
FIG. 16A is an architecture diagram of a system for implementing a multi-mode multi-jurisdiction skill wagering interleaved game having a regulated GW.OS and real world operating system (RC.OS) and an unregulated GW.OS and RC.OS in accordance with embodiments of the invention.
Figure 16B:
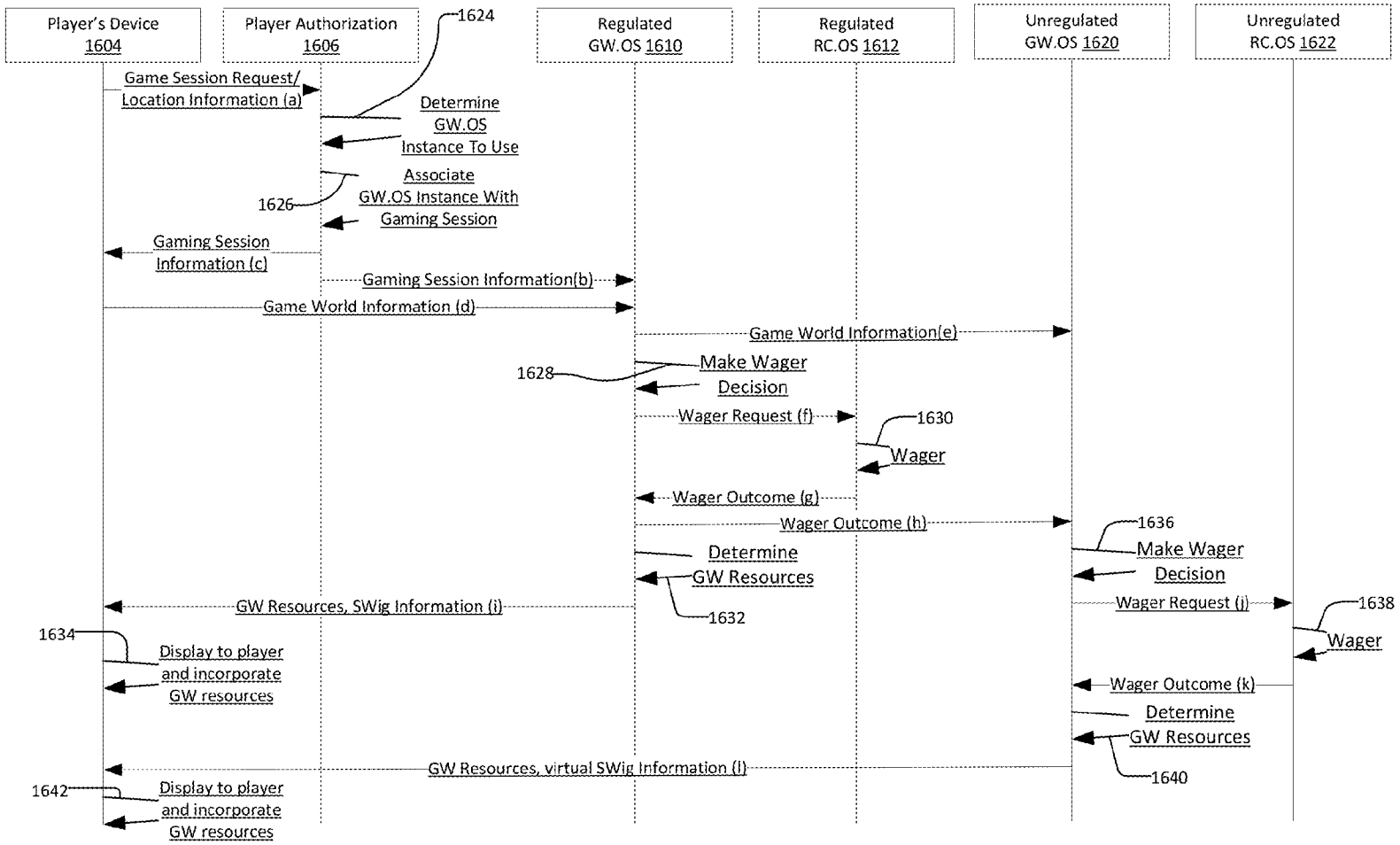
FIG. 16B is a sequence diagram for an operational process of a multi-mode multi-jurisdiction skill wagering interleaved game in accordance with embodiments of the invention.

FIG. 16A is an architecture diagram of a system for implementing a multi-mode multi-jurisdiction skill wagering interleaved game having a regulated GW.OS and RC.OS for real money gaming and an unregulated GW.OS and RC.OS for virtual currency gaming in accordance with embodiments of the invention and FIG. 16B is a sequence diagram for an operational process of a multi-mode multi-jurisdiction skill wagering interleaved game in accordance with embodiments of the invention. Referring now to FIGS. 16A and 16B, a system 1600 implementing a multi-mode multi-jurisdiction skill wagering interleaved game couples to a player's device 1604 over a network (not shown) such as a LAN or a WAN. The player's device includes an instantiation of a SWig Eg 1605 that a player will play during a gaming session. A firewall 1602 admits communications from the player' device to a player authorization module 1606 and to a message dispatcher module 1608.

The system further includes one or more regulated GW.OSes, such as GW.OS 1610, that may run concurrently. The system also includes one or more unregulated GW.OSes, such as unregulated GW.OS 1620, that may run concurrently. The system further includes one or more regulated RC.OSes, such as RC.OS 1612, and one or more unregulated RC.OSes, such as RC.OS 1622, that may be running concurrently. A combination of a regulated RC.OS, such as the regulated RC.OS 1612, and a regulated GW.OS, such as the regulated GW.OS 1610, is used for real money gaming. A combination of an unregulated RC.OS, such as the unregulated RC.OS 1622, and an unregulated GW.OS, such as the unregulated GW.OS 1620, is used for virtual currency gaming. By using both an unregulated RC.OS/GW.OS combination with a regulated RC.OS/GW.OS, real money gaming may be combined with virtual currency gaming. In various embodiments, the use of regulated and unregulated GW.OSes and regulated and unregulated RC.OSes allows for any combination of real money gaming, virtual currency gaming and in-game purchases to be conducted through appropriate configuration of a GW.OS and an RC.OS when they are instantiated by the system 1600. The system 1600 also includes a patron authorization database 1614 used to store session information.

Referring to both FIGS. 16A and 16B, in operation, the player's device 1604 transmits a request (a) for a gaming session to the player authorization module 1606. The gaming session request includes location information that may be used by the player authorization module 1606 to determine the location of the player's device 1604 using a geolocation service as described herein. The player authorization module 1606 selects (1624; FIG. 16B) a GW.OS that is appropriate for the player's device's location, and associates (1626; FIG. 16B) the selected GW.OS with the gaming session. For example, if the player's device is located where real money gaming is allowed, the player authorization module 1606 selects a regulated GW.OS 1610 that enables real money gaming. In addition, when it is desired that the gaming session include virtual currency gaming or purchasing of in-game items, an unregulated GW.OS 1620 is also selected. The player authorization module transmits gaming session information (b) to the selected GW.OSes, thereby notifying the selected GW.OSes that the selected GW.OSes have been selected and bound to a gaming session. This information regarding the gaming session binding the GW.OSes to the player's device 1604 is also stored in the patron authorization database 1614 for future reference. Information about the gaming session (c) is transmitted to the player's device 1604 by the player authorization module 1606.

During the gaming session, the player's device 1604 transmits game world information (d) to the regulated GW.OS 1610 through the dispatcher 1608. The game world information includes session information that the dispatcher 1608 broadcasts to all regulated GW.OSes within the system that have been instantiated and bound to a gaming session. If the broadcast gaming session information matches the game session information that the regulated GW.OS 1610 has, indicating that the regulated GW.OS 1610 was bound to that particular gaming session, the regulated GW.OS 1610 receives the game world information and determines (1628; FIG. 16B) a wagering decision as described herein. In addition, the regulated GW.OS 1610 broadcasts (e) the game world information such that any unregulated GW.OSes can receive the game world information. The unregulated GW.OS 1620 receives the broadcast game world information. If the regulated GW.OS 1610 determines that a real money wager is to be made, the regulated GW.OS 1610 transmits a real money wager request (f) to the regulated RC.OS 1612. The regulated RC.OS 1612 receives the real money wager request and makes (1630; FIG. 16B) the requested real money wager. The regulated RC.OS 1612 transmits the real money wager outcome (g) to the regulated GW.OS 1610.

The regulated GW.OS 1610 receives the real money wager outcome. The regulated GW.OS 1610 broadcasts the real money wager outcome and any instantiated unregulated GW.OSes receive the broadcast real money wager outcome and make a determination as to whether or not the real money wager outcome is from a regulated GW.OS to which the unregulated GW.OS is bound in a gaming session. If the real money wager outcome is from a mutually bound regulated GW.OS, the unregulated GW.OS 1620 accepts the real money wager outcome for subsequent processing. The regulated GW.OS 1610 uses the real money wager outcome to make decisions (1632; FIG. 16B) about what game world resources should be allocated in the gaming session as a result of the real money wager outcome and game world information as described herein.

The regulated GW.OS 1610 transmits the game world resources and real money SWig information regarding the real money wager and real money wager outcome (i) as described herein to the player's device 1604. The player's device 1604 receives the game world resources and the real money SWig information. The game world resources are provided to the game engine of the Eg 1605 and incorporated into the game session by the game engine of the Eg 1605. The real money SWig information is displayed (1634; FIG. 16B) to the player as described herein.

The unregulated GW.OS 1620 uses the game world information and the real money wager outcome to make a determination as to whether or not a virtual currency wager should be made to make (1636; FIG. 16B) a wager decision as described herein. If a virtual currency wager is to be made, the unregulated GW.OS 1620 transmits a request for a virtual currency wager (j) to the unregulated RC.OS 1622. The unregulated RC.OS 1622 receives the request for a virtual currency wager and executes (1638; FIG. 16B) the virtual currency wager. The unregulated RC.OS 1622 transmits the virtual currency wager outcome to the unregulated GW.OS 1620. The unregulated GW.OS 1620 uses the virtual currency wager outcome, the real money wager outcome and the game world information to determine (1640; FIG. 16B) game world resources that should be awarded to the player through the game engine of the Eg 1605. The unregulated GW.OS 1620 transmits the game world resources and virtual currency SWig information (I) to the player's device 1604. The player's device 1604 receives the game world resources and incorporates them into the game world engine for use by the player. The player's device 1604 also displays (1642; FIG. 16B) the virtual currency SWig information to the player.

In some embodiments, the regulated GW.OS 1610 makes decisions about whether or not to make a real money wager but does not make decisions about what game world resources to award to the player based on real money wagering. Decisions about what game world resources to provide to the Eg 1605 are made by the unregulated GW.OS 1620.

In numerous embodiments, the unregulated GW.OS 1620 does not engage in any virtual money wagering but functions to enable in-game purchases of in-game resources.

In many embodiments, the dispatcher 1608, player authorization module 1606, RC.OSes 1612 and 1622, GW.OSes 1610 and 1620, and patron authorization datastore 1614 are all instantiated on the same hosting device and/or server. In some embodiments, the dispatcher 1608, player authorization module 1606, RC.OSes 1612 and 1622, GW.OSes 1610 and 1620, and patron authorization datastore 1614 may be instantiated on more than one hosting device and/or server.

Figure 17:
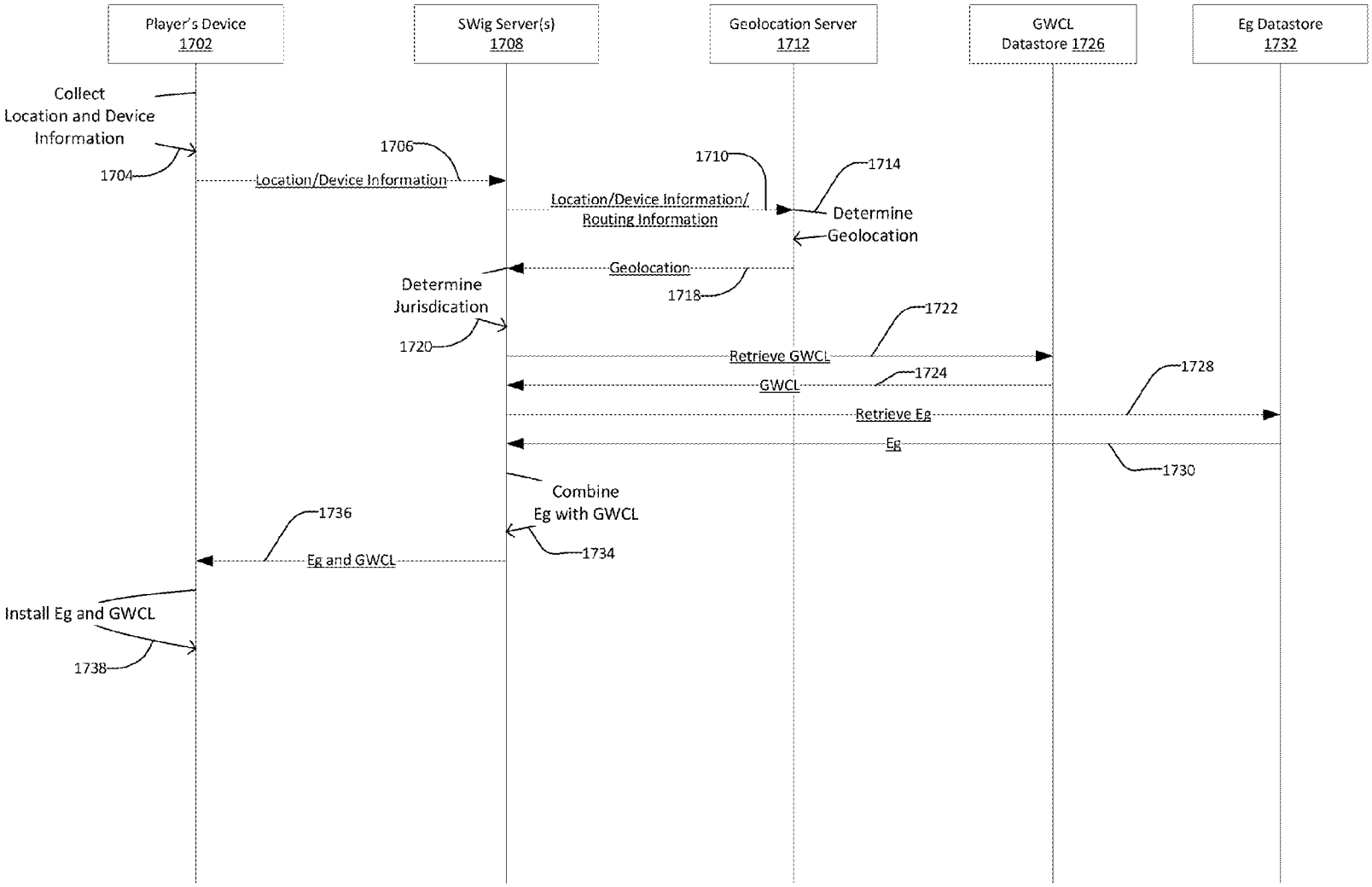
FIG. 17 illustrates a sequence of operations for a system for publishing a multi-mode multi-jurisdiction skill wagering interleaved game in accordance with embodiments of the invention.

FIG. 17 illustrates a sequence of operations for a system for publishing a multi-mode multi-jurisdiction skill wagering interleaved game in accordance with embodiments of the invention. A player's device 1702 that is part of a multi-mode multi-jurisdiction skill wagering interleaved game system collects information (1704) about the player's device 1702 to be used for geographical location. In some embodiments, the player's device 1702 may have access to GPS information. The player's device transmits (1706) the device information to a SWig server 1708, including the GPS information if available. The SWig server 1708 receives the player's device information. In addition, the Swig server 1708 collects network information for the access point used by the player's device 1702 to access a network used by the player's device 1702 to connect to the one or more SWig servers 1708. The access point information and GPS data, if available, is forwarded (1710) to a geographical location server 1712. The geographical location server 1712 receives the device information and the access point information. The geographical location server 1712 determines (1714) a physical location of the access point used by the player's device using tabulated network addresses of the access points associated with geographic locations of the access points. In some embodiments, if the information sent by the one or more SWig servers 1708 includes GPS information collected by the player's device, the GPS information may be correlated with the access point information to confirm the location of the player's device 1702.

The geographical location server 1712 transmits (1718) the geographical location of the player's device 1702 to the one or more SWig servers 1708. The one or more SWig servers 1708 determine (1720) in which gambling jurisdiction the player's device 1702 is located using the geographical location. Based on the jurisdiction, the one or more SWig servers 1708 select and/or retrieve (1722, 1724) game world control layer control logic from a game world control layer data store 1726.

For example, if the jurisdiction in which the player's device is located allows for real money gaming, the selected game world control layer control logic will enable the player's device 1702 to access one or more SWig servers 1708 that are enabled for real money gaming utilizing a real money gaming RC.OS. However, if the jurisdiction in which the player's device 1702 is located does not allow for real money gaming, the selected game world control layer logic will not allow the player's device 1702 to couple to SWig servers 1708 that enable real money gaming. Instead, the game world control layer logic will only allow coupling to SWig servers 1708 that enable virtual currency gaming.

As another example, if the jurisdiction in which the player's device 1702 is located allows real money gaming, then game world control layer control logic may be selected that allows coupling by the player's device to SWig servers 1708 for both real money gaming and virtual currency gaming. As another example, game world control layer control logic may be selected that allows in-game purchases using real currency. Other embodiments of game world control layer control logic allow for different possible combinations of real money gaming, virtual currency gaming, and in-game purchases. The selected game world control layer control logic is used by an Eg to implement a game world control layer such as the game world control layer 170 of FIG. 1.

The one or more SWig servers 1708 also retrieve (1728, 1730) Eg control logic from an Eg datastore 1732. The Eg control logic is used to implement an Eg such as Eg 120 of FIG. 1. The one or more SWig servers 1708 combine (1734) the Eg control logic with the game world control layer control logic to create a functional Eg with a game world control layer as depicted in FIG. 1. The combined Eg and game world control layer are transmitted (1736) to the player's device 1702. The player's device receives the combined Eg and game world control layer and installs (1738) the combined Eg and game world control layer for operation as described herein.

In some embodiments, the Eg control logic and game world control layer control logic are implemented in a high level programming language that are combined and compiled into one or more machine executable software programs, applications, modules or the like that are installed into the player's device.

In numerous embodiments, the Eg control logic and game world control layer control logic are separate machine executable software components that are installed as a package on the player's device. During operation, the Eg control logic calls the game world control layer control logic through an application programming interface or the like in order to communicate with one or more SWig servers.

In some embodiments, the Eg is a host running a browser that communicates with a server serving documents in a markup language, such as Hypertext Markup Language 5 (HTML 5) or the like, and the functions of the game engine are performed by the browser on the basis of the markup language found in the documents. In such embodiments, the game world control layer control logic is implemented as a browser plug in. In some embodiments, the Eg is a host hosting a specialized software platform, such as Adobe Flash or the like, used to implement games or other types of multimedia presentations, and the functions of the game engine are performed by the specialized platform. In such embodiments, the game world control layer may be implemented as an application interface or the like or may integrated within the game engine.

Figure 18:
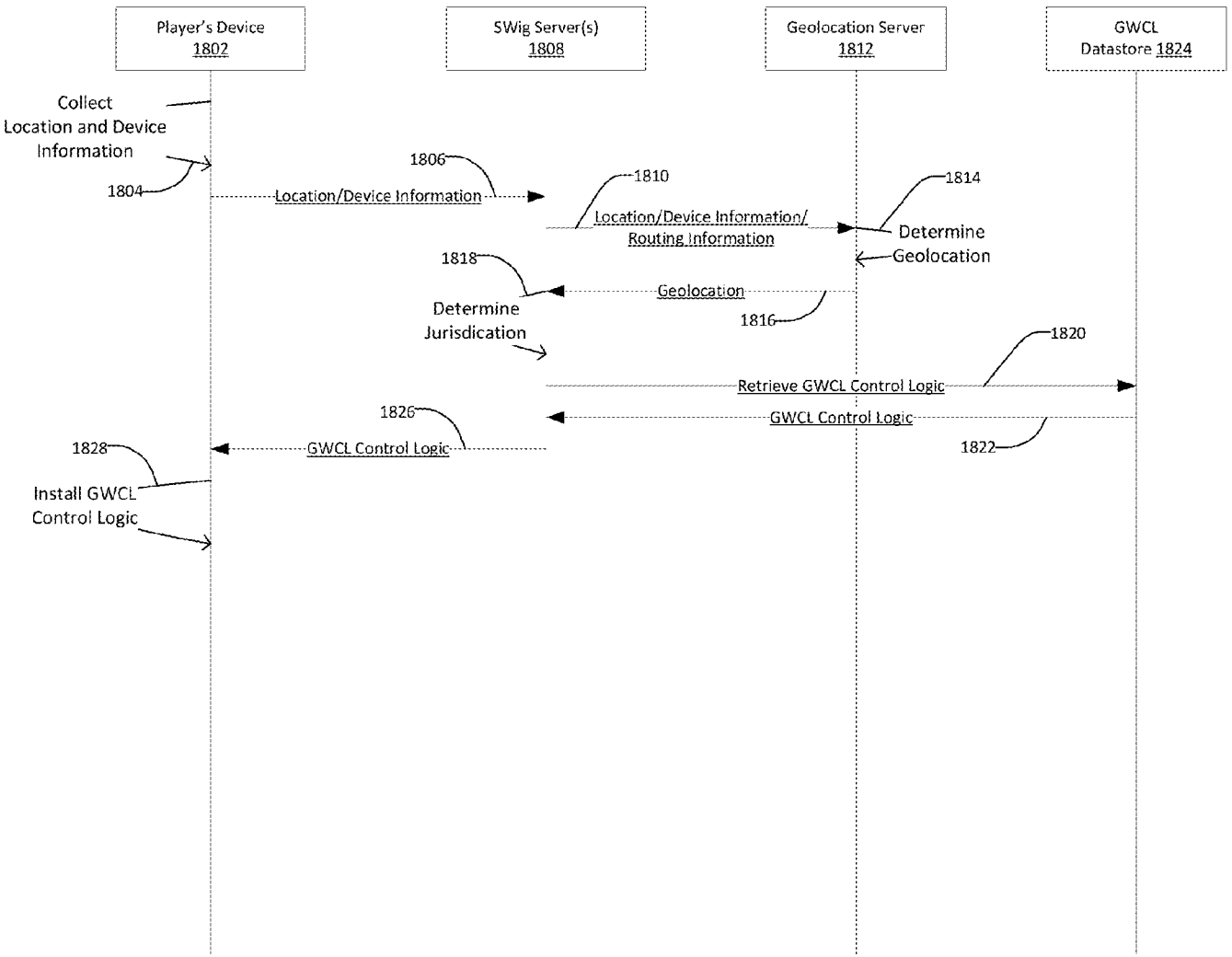
FIG. 18 illustrates a sequence of operations for a multi-mode multi-jurisdiction skill wagering interleaved game in accordance with embodiments of the invention.

FIG. 18 illustrates a sequence of operations for a multi-mode multi-jurisdiction skill wagering interleaved game in accordance with embodiments of the invention. In this embodiment, the game world control layer control logic is provided to the player's device. In operation, a player's device 1802 that is part of a multi-mode multi-jurisdiction skill wagering interleaved game system collects (1804) information about the player's device 1802 to be used for geographical location. In some embodiments, the player's device 1802 may have access to GPS information. The player's device 1802 transmits (1806) the device information to a SWig server 1808, including the GPS information if available. The SWig server 1808 receives the player's device 1802 information. In addition, the Swig server 1808 collects network information for the access point used by the player's device to access a network used by the player's device to connect to one or more SWig servers 1808. The access point information and GPS data, if available, is forwarded (1810) to a geographical location server 1812. The geographical location server 1812 receives the device information and the access point information. The geographical location server determines (1814) a physical location of the access point used by the player's device 1802 using tabulated network addresses of the access points associated with geographic locations of the access points. In some embodiments, if the information sent by the one or more SWig servers 1808 includes GPS information collected by the player's device 1802, the GPS information may be correlated with the access point information to confirm the location of the player's device 1802.

The geographical location server 1812 transmits (1816) the geographical location of the player's device 1802 to the one or more SWig servers 1808. The one or more SWig servers 1808 determine (1818) in which gambling jurisdiction the player's device is located using the geographical location. Based on the jurisdiction, the one or more SWig servers select and/or retrieve (1820, 1822) game world control layer control logic from a game world control layer data store 1824.

For example, if the jurisdiction in which the player's device 1802 is located allows for real money gaming, the selected game world control layer control logic will enable the player's device 1802 to access one or more SWig servers 1808 that are enabled for real money gaming utilizing a real money gaming RC.OS. However, if the jurisdiction that the player's device 1802 is located does not allow for real money gaming, the selected game world control layer logic will not allow the player's device 1802 to couple to SWig servers 1808 that enable real money gaming. Instead, the game world control layer logic will only allow coupling to SWig servers 1808 that enable virtual currency gaming.

As another example, if the jurisdiction in which the player's device 1802 is located allows real money gaming, then game world control layer control logic may be selected that allows coupling by the player's device 1802 to SWig servers 1808 for both real money gaming and virtual currency gaming. As another example, game world control layer control logic may be selected that allows in-game purchases using real currency. Other embodiments of game world control layer control logic allow for different possible combinations of real money gaming, virtual currency gaming, and in-game purchases. The selected game world control layer control logic is used by an Eg to implement a game world control layer such as the game world control layer 170 of FIG. 1. The selected game world control layer control logic is transmitted (1826) to the player's device 1802. The player's device 1802 receives the selected game world control layer control logic and installs (1828) the selected game world control layer control logic on the player's device 1802 for operation as described herein.

In some embodiments, the game world control layer control logic is written in a high level programming language that is combined and compiled into one or more machine executable software programs, applications, modules, or the like that are installed into the player's device.

In numerous embodiments, the game world control layer control logic is a machine executable software component separate from the Eg that is installed as part of a software package on the player's device. During operation, the Eg control logic calls the game world control layer control logic through an application programming interface or the like in order to communicate with one or more SWig servers.

In some embodiments, the Eg is implemented as a web based game operated on a browser or the like, and the game world control layer control logic is implemented as a browser plug in.

While the above description may include many specific embodiments of the invention, these should not be construed as limitations on the scope of the invention, but rather as an example of one embodiment thereof. It is therefore to be understood that the present invention can be practiced otherwise than specifically described, without departing from the scope and spirit of the present invention. Thus, embodiments of the present invention should be considered in all respects as illustrative and not restrictive.

What is claimed is:

1. A distributed gaming system comprising:

a player's device connected to a skill wagering interleaved gaming (SW.ig) server by a network, wherein the player's device is configured to:

determine by the player's device, location information including a geographical location of the player's device;

provide to the SW.ig system via the network, the location information including the geographical location of the player's device;

receive from the SW.ig system via the network, game world control layer control logic;

install on the player's device the game world control layer control logic; and connect the player's device via the network to a selected game world operating system (GW.OS) of the SW.ig server using the game world control layer control logic; and the SW.ig server connected to the player's device by the network, wherein the SW.ig server is constructed to:

provide a virtual currency GW.OS configured to initiate a virtual currency wager;

provide a real currency GW.OS configured to initiate a real currency wager;

receive the location information from the player's device;

determine the geographical location of the player's device based on the location information;

select the game world control layer control logic based on the geographical location, wherein, in a case that the geographical location of the player's device is in a jurisdiction allowing real currency wagers, the game world control layer control logic is configured to connect the player's device to the real currency GW.OS as the selected GW.OS, and wherein, in a case that the geographical location of the player's device is in a jurisdiction not allowing real currency wagers, the game world control layer control logic is configured to connect the player's device to the virtual currency GW.OS as the selected GW.OS; and provide to the player's device via the network, the game world control layer control logic.

2. The distributed gaming system of claim 1, wherein the location information comprises global positioning system (GPS) data of the player's device or network access point information of the player's device, and wherein the SW.ig server is further constructed to determine the geographical location of the player's device based on the GPS data or the network access point information.

3. The distributed gaming system of claim 1, wherein the SW.ig server is further constructed to:

select an entertainment game control logic based on the geographical location; and provide to the player's device via the network, the entertainment game control logic, and wherein the player's device is further configured to:

receive from the SW.ig server via the network, the entertainment game control logic; and install on the player's device the entertainment game control logic.

* * * * *